US010485310B2

(12) United States Patent
Harris et al.

(10) Patent No.: US 10,485,310 B2
(45) Date of Patent: Nov. 26, 2019

(54) ACCESSORIES WITH SLIDING KEEPSAKES

(71) Applicant: STELLA & DOT LLC, San Bruno, CA (US)

(72) Inventors: Blythe Elizabeth Harris, San Bruno, CA (US); Charlotte Valerie Macaulay, San Bruno, CA (US); Rahul Gupta, San Bruno, CA (US); Jessica Herrin, San Bruno, CA (US)

(73) Assignee: Stella & Dot LLC, San Bruno, CA (US)

( * ) Notice: Subject to any disclaimer, the term of this patent is extended or adjusted under 35 U.S.C. 154(b) by 0 days.

(21) Appl. No.: 14/825,468

(22) Filed: Aug. 13, 2015

(65) Prior Publication Data

US 2016/0051016 A1 Feb. 25, 2016

Related U.S. Application Data

(60) Provisional application No. 62/040,360, filed on Aug. 21, 2014.

(51) Int. Cl.

| | |
|---|---|
| ***A44C 5/10*** | (2006.01) |
| ***A44C 25/00*** | (2006.01) |
| ***A44C 5/00*** | (2006.01) |
| ***A44C 5/02*** | (2006.01) |
| ***A44C 17/02*** | (2006.01) |

(52) U.S. Cl.

CPC ..... *A44C 25/001* (2013.01); *A44C 5/0015* (2013.01); *A44C 5/025* (2013.01); *A44C 17/0241* (2013.01)

(58) Field of Classification Search

CPC ..... A44C 5/0053; A44C 5/02; A44C 5/025; A44C 25/00; A44C 25/007; A44C 1/00

USPC ..... 63/5.1, 11, 21, 23, 40

See application file for complete search history.

(56) References Cited

U.S. PATENT DOCUMENTS

| | | | | | |
|---|---|---|---|---|---|
| 1,694,703 | A | * | 12/1928 | Doppenschmitt | 63/11 |
| 1,764,175 | A | * | 6/1930 | Kerkhoff | 40/618 |
| D158,918 | S | * | 6/1950 | Winn | D10/32 |
| 4,305,262 | A | * | 12/1981 | Ferrara | 63/29.1 |
| 4,430,869 | A | | 2/1984 | Zinni | |
| 4,879,882 | A | | 11/1989 | Johnson et al. | |
| 5,081,852 | A | | 1/1992 | Cox | |

(Continued)

FOREIGN PATENT DOCUMENTS

| | | |
|---|---|---|
| CN | 203168195 U | 9/2013 |
| DE | 8624702 U1 | 1/1987 |

(Continued)

OTHER PUBLICATIONS

Co-pending U.S. Appl. No. 15/844,272, filed Dec. 15, 2017.

(Continued)

*Primary Examiner* — Emily M Morgan

(74) *Attorney, Agent, or Firm* — Wilson Sonsini Goodrich & Rosati

(57) ABSTRACT

Accessories, such as articles of jewelry, are provided having one or more keepsakes that may slide to on or off the accessory substrate. The keepsakes may have a decorative front side and a rear side that may cause the keepsake to encircle the substrate. The rear side may have a greater length than the front side, which may permit natural spacing between the front sides of adjacent keepsakes.

15 Claims, 20 Drawing Sheets

(56) References Cited

U.S. PATENT DOCUMENTS

| | | | | |
|---|---|---|---|---|
| 5,307,582 | A * | 5/1994 | Quintel | A01K 27/001 224/183 |
| D400,118 | S * | 10/1998 | Itzkowitz | D11/4 |
| 5,836,176 | A | 11/1998 | Lichtenstein et al. | |
| 6,880,364 | B1 * | 4/2005 | Vidolin et al. | 63/40 |
| 7,007,507 | B2 | 3/2006 | Enevoldsen | |
| D712,773 | S * | 9/2014 | Mounce | D11/4 |
| D716,172 | S * | 10/2014 | Howe | D11/3 |
| 2007/0153639 | A1 * | 7/2007 | Lafever et al. | 368/282 |
| 2007/0186455 | A1 | 8/2007 | Lin | |
| 2008/0223889 | A1 * | 9/2008 | Rossell et al. | 224/222 |
| 2008/0245048 | A1 * | 10/2008 | Moore | 59/80 |
| 2010/0075073 | A1 | 3/2010 | O'Byrne et al. | |
| 2010/0282378 | A1 | 11/2010 | Scozzafava | |
| 2010/0300146 | A1 * | 12/2010 | Klecka | 63/3 |
| 2011/0048072 | A1 * | 3/2011 | Mullen et al. | 63/3.1 |
| 2011/0061424 | A1 | 3/2011 | Gupta | |
| 2012/0080472 | A1 | 4/2012 | Locke | |
| 2012/0260541 | A1 | 10/2012 | Toussoun et al. | |
| 2012/0267018 | A1 | 10/2012 | Murphy Garcia | |
| 2012/0297827 | A1 * | 11/2012 | Mellinger et al. | 63/33 |
| 2013/0032258 | A1 | 2/2013 | Rash et al. | |
| 2013/0239610 | A1 | 9/2013 | Lim | |
| 2013/0305779 | A1 | 11/2013 | Gallagher et al. | |
| 2013/0306206 | A1 | 11/2013 | Quinnan | |
| 2014/0093850 | A1 | 4/2014 | Georgi | |
| 2014/0223961 | A1 | 8/2014 | Mullins | |
| 2014/0250671 | A1 | 9/2014 | Murphy Garcia | |
| 2014/0261933 | A1 | 9/2014 | Jones | |
| 2015/0033518 | A1 * | 2/2015 | Moritz | A44B 11/22 24/68 E |
| 2015/0121730 | A1 | 5/2015 | Freer | |
| 2016/0198817 | A1 | 7/2016 | Berka et al. | |

FOREIGN PATENT DOCUMENTS

| | | | |
|---|---|---|---|
| FR | 2716352 | A1 | 8/1995 |
| WO | WO 2014/032075 | A1 | 3/2014 |

OTHER PUBLICATIONS

"Ali Express: Slide Bracelet Charms. Accessed online Oct. 8, 2015, Aug. 13, 2014, viewed at http://www.aliexpress.com/popular/slide-bracelet-charms.html".

"Bluestreak Beads: Leather Bracelet & Cuff Kits. Accessed online Oct. 8, 2015, Sep. 1, 2013, viewed at http://www.bluestreakbeads.co.uk/ecom-catshow/Leather-bracelet-and-cuff-kits.html".

"Bluestreak Beads: Leather Cuff Kit Black & Aqua. Accessed online Oct. 8, 2015, Sep. 1, 2013, viewed at http://www.bluestreakbeads.co.uk/ecom-prodshow/Leather-cuff-kit-4.html".

"International search report and written opinion dated Nov. 20, 2015 for PCT Application No. US2015/045066."

Co-pending U.S. Appl. No. 15/957,762, filed Apr. 19, 2018.

EP15834200.6 Extended European Search Report and Search Opinion dated Mar. 8, 2018.

PCT/US2018/028446 International Search Report and Written Opinion dated Jul. 5, 2018.

U.S. Appl. No. 15/844,272 Office Action dated May 14, 2019.

Agatha Paris. AGAT'you: a totally new jewellery concept! Accessed Jun. 4, 2015. http://www.agatha.co.nz/agatha-paris-collections/agatha-paris-agat-you.html.

Agatha Paris. AGAT'You CARREE. Accessed Jun. 4, 2015. http://www.agatha.co.nz/agatha-paris-collections/agatha-paris-agat-you/agatha-paris-agat-you-slide-charms/2750257-064-tu.html.

Astley Clarke. Bolsena recipe for exquisite luxury jewellery brand. Published Dec. 5, 2012. http://www.astleyclarke.com/blog/2012/11/02/recipe-for-exquisite-luxury-jewellery-brand/bolsena/.

Astley Clarke. Wondering how to wear Astley Clarke bolsena? Published Nov. 10, 2012. http://www.astleyclarke.com/blog/2012/11/10/wondering-how-to-wear-astley-clarke-bolsena-read-watch-on/.

BCBGeneration. Charms—demandware. Accessed Jun. 4, 2015. http://www.bcbgeneration.com/on/demandware.store/Sites-BCBGeneration-Site/default/Search-Show?q=make%20your%20own.

BCBGeneration. Mini make your own affirmation bracelet. Accessed Jun. 4, 2015. http://www.bcbgeneration.com/Mini-Make-Your-Own-Custom-Affirmation-Bracelet/BC10014-100,default,pd.html.

La Mer Collections. Handmade wrap watches. Accessed Jun. 4, 2015. https://www.lamercollections.com/.

La Mer Collections. Limited Edition Hirst Dots Silver Interchangeable Watch. Accessed Jun. 4, 2015. http://www.lamercollections.com/shop/Hirst-Dots-Silver-Interchangeable-Watch/.

Lori Bonn Design. Main website. Accessed Jun. 4, 2015. https://www.loribonn.com/.

Lori Bonn. Charm School 101: how to design your own slide charm bracelet. Accessed Jun. 4, 2015. https://www.loribonn.com/charm-school-101.

Origami Owl. Custom Jewelry. Accessed Jun. 4, 2015. https://www.origamiowl.com/shop.

Tory Burch. Customizable Lucia Initial Charm Bracelet. Accessed Jun. 4, 2015. http://www.toryburch.com/customizable-lucia-initial-charm-bracelet/41135888.html.

Tory Burch. Personalized Charms. The Charm Collection. Accessed Jun. 4, 2015. http://www.toryburch.com/handbags/personalized-charms/.

* cited by examiner

ACCESSORIES WITH SLIDING KEEPSAKES

CROSS-REFERENCE

This application claims the benefit of U.S. Provisional Application No. 62/040,360, filed Aug. 21, 2014, which application is incorporated herein by reference.

BACKGROUND OF THE INVENTION

Charm bracelets provide a way of providing personalized jewelry. Wearers may select charms of significance or appeal to the wearer. Charm bracelets may be worn with charms that may dangle from the bracelets. For example, charm bracelets may include linked bracelets onto which a three-dimensional charm may attach. However, in some instances, a wearer may not want dangling charms due to personal aesthetic choices, or interference or noise caused by the dangling charms.

SUMMARY OF THE INVENTION

A need exists for accessories, such as jewelry, that is personalized and enables a wearer to select individualized keepsakes without running into inconvenience caused by many dangling charms. In some embodiments, it may be desirable to provide accessories, such as jewelry, where the keepsakes may slide onto the article of jewelry. For example, the keepsakes may slide onto a wristband, bangle, mesh bracelet, pendant, choker, earring, anklet, belt, headband, shoes (e.g., sandals), gloves, glasses/sunglasses, pet-collars, keychains, or other type of jewelry or accessory. Any description herein of jewelry will apply to any other type of accessory, and any description herein of an accessory may apply to any type of accessory, such as jewelry. In some embodiments, the jewelry (or any type of accessory) may be reversible. The keepsakes may have a front side that shows the various decorations, and a backside that may assist with keeping the keepsake on the article of jewelry (or any type of accessory). The back side may optionally have a greater length than the front side. This may keep the keepsakes spaced apart when viewing the front decorative sides of the keepsakes.

An aspect of the invention is directed to an accessory comprising: a base comprising a flat, elongated member having a front face and an opposing back face; and at least one keepsake that slides onto the elongated member, wherein the keepsake has a front side contacting the front face of the elongated member and showing a decorative portion of the keepsake, and a back side contacting the back face of the elongated member, and wherein the back side overlaps with at least a portion of the front side and extends beyond a length of the front side.

In some embodiments, the base is a bracelet. The bracelet may be a semi-rigid wristband, mesh bracelet, or a bangle. In some other embodiments, the base is a pendant.

The front side of the keepsake may have a substantially flat inner surface, and the back side of the keepsake may have a substantially flat inner surface. The front side of the keepsake or the back side of the keepsake may have an inner surface that includes curves, bumps, or grooves. The curves, bumps, or grooves may prevent sliding of the keepsake in the absence of an external force. The back side of the keepsake may include at least one cross bar extending along the width of the keepsake and one or more side or extension features. The back side may include the at least one cross bar and the one or more side or extension features may be formed of a single integral piece. The back side may include at least one hole surrounded by the at least one cross bar and the at least one side or extension features.

The keepsake may be a locket comprising a base portion and a cover portion movable relative to the base portion about a pivot.

Additional aspects of the invention may be directed to an accessory comprising: a base comprising a flat, elongated member having a front face and an opposing back face; a first keepsake that slides onto the elongated member, wherein the first keepsake has a first front side contacting the front face of the elongated member and showing a decorative portion of the keepsake, and a first back side contacting the back face of the elongated member and overlapping with at least a portion of the first front side; and a second keepsake that slides onto the elongated member, wherein the second keepsake has a second front side contacting the front face of the elongated member and showing a decorative portion of the keepsake, and a second back side contacting the back face of the elongated member and overlapping with at least a portion of the second front side, wherein the first front side and the second front side are configured to not come into contact with one another when the first back side comes into contact with the second back side.

The first keepsake and the second keepsake may be configured to be held to a location on the base with the aid of friction between the first keepsake and the base, and between the second keepsake and the base, in the absence of an external force. The accessory may further comprise a stopper, wherein the stopper comprises a front side contacting the front face of the elongated member and a back side contacting the back face of the elongated member, and wherein the stopper prevents motion of the first keepsake or the second keepsake past the stopper along the length of the base. The back side of the keepsake may include at least one cross bar extending along the width of the keepsake and one or more side or extension features.

A pendant may be provided in accordance with further aspects of the invention. The pendant may comprise: a body comprising a flat, elongated member having a front face and an opposing back face; and at least one keepsake that slides onto the elongated member, wherein the keepsake has a front side contacting the front face of the elongated member and showing a decorative portion of the keepsake, and a back side contacting the back face of the elongated member.

The at least one keepsake may be removable or exchangeable for another keepsake on the elongated member.

The pendant may further comprise a base of greater thickness than the body, wherein the base is configured to prevent the at least one keepsake from sliding past the base along the elongated member. The base may be integrally formed with the body.

The at least one keepsakes may comprise: a first keepsake that slides onto the elongated member, wherein the first keepsake has a first front side contacting the front face of the elongated member and showing a decorative portion of the keepsake, and a first back side contacting the back face of the elongated member and overlapping with at least a portion of the first front side; and a second keepsake that slides onto the elongated member, wherein the second keepsake has a second front side contacting the front face of the elongated member and showing a decorative portion of the keepsake, and a second back side contacting the back face of the elongated member and overlapping with at least a portion of the second front side, wherein the first front side and the second front side are configured to have a gap between one another when the first back side comes into contact with the second back side.

Additional aspects and advantages of the present disclosure will become readily apparent to those skilled in this art from the following detailed description, wherein only exemplary embodiments of the present disclosure are shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIG. 1A shows front sides of the keepsakes and FIG. 1B shows back sides of the keepsakes.

FIG. 2A shows a front side of an example of a keepsake. FIG. 2B shows a side view of an example of a keepsake. FIG. 2C shows a back side of the keep sake. FIG. 2D shows a top side of the keepsake. FIG. 2E shows a front side of another example of a keepsake. FIG. 2F shows a side view of the other example of a keepsake. FIG. 2G shows a back side of the other example of a keep sake. FIG. 2H shows a top side of the other example of a keepsake.

FIG. 4A shows an example of a wristband. FIG. 4B shows an example of a wristband with a first face as an outer face, and keepsakes mounted thereon. FIG. 4C shows a rear view of the wristband with a first face as the outer face and keepsakes mounted thereon. FIG. 4D shows an example of a wristband with a second face as an outer face, and keepsakes mounted thereon.

FIG. 5A shows an example of a multi-wrap wristband. FIG. 5B shows an example of the multi-wrap wristband with keepsakes mounted thereon.

FIG. 6A shows an example of a mesh bracelet. FIG. 6B shows an example of the mesh bracelet with keepsakes mounted thereon. FIG. 6C shows a rear view of a mesh bracelet with keepsakes mounted thereon. FIG. 6D shows an example of keepsakes mounted on a mesh bracelet using stoppers.

FIG. 7A shows a front view of a bangle. FIG. 7B shows a bottom view of the bangle. FIG. 7C shows a rear view of the bangle. FIG. 7D shows an example of a bangle with keepsakes thereon. FIG. 7E shows a view of the bangle with a rear view of the keepsakes thereon.

FIG. 8A shows a rear view of the pendant. FIG. 8B shows a front view of the pendant. FIG. 8C shows a bottom view of the pendant. FIG. 8D shows an example of a pendant with keepsakes mounted thereon. FIG. 8E shows an example of a rear view of a pendant with keepsakes mounted thereon.

FIG. 9A shows a front side of a timepiece keepsake on a wristband. FIG. 9B shows a back side of a timepiece keepsake on a wristband.

DETAILED DESCRIPTION OF THE INVENTION

While preferable embodiments of the invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

The invention provides accessories with sliding keepsakes. Any description herein of jewelry may apply to any type of accessory, and vice versa. Any features from particular jewelry embodiments may apply to various other accessory embodiments, and vice versa. Various aspects of the invention described herein may be applied to any of the particular applications set forth below or for any other types of jewelry or accessories. The invention may be applied as a standalone device, or as part of an integrated accessorizing or design system. It shall be understood that different aspects of the invention can be appreciated individually, collectively, or in combination with each other.

Accessories, such as jewelry, may be personalized to allow a wearer to select individualized keepsakes that may slide onto an accessory substrate, such as a jewelry substrate. The keepsakes may have individualized designs and may aid in providing personalized decoration of the accessory, such as the article of jewelry. The keepsakes may slide onto accessory substrates, such as a wristband, bangle, mesh bracelet, pendant, choker, earring, anklet, belt, headband, shoes (e.g., sandals), gloves, glasses/sunglasses, pet-collars, keychains, or other type of jewelry or accessory. In some instances, jewelry may include various types of wrist accessories (e.g., different types of bracelets, watches), necklaces (e.g., pendants), earrings, or anklets. Accessories may include any type of jewelry, or may include other objects that may be worn or carried by a user or pet (e.g., hair accessories (e.g., headbands, hair pins, hair scarves), footwear (e.g., sandals, pumps, flats, platforms, sneakers, loafers, slippers), belts, eyewear (e.g., glasses/sunglasses/monocles), handwear (e.g., gloves, mittens), scarves, pet accessories, keychains, or other types of accessories.

In some embodiments, the accessories/jewelry may be reversible. The keepsakes may have a front side that shows the various decorations, and a backside that may assist with keeping the keepsake on the accessory. The back side may optionally have a greater length than the front side. This may keep the keepsakes spaced apart when viewing the front decorative sides of the keepsakes.

Figure 1A:
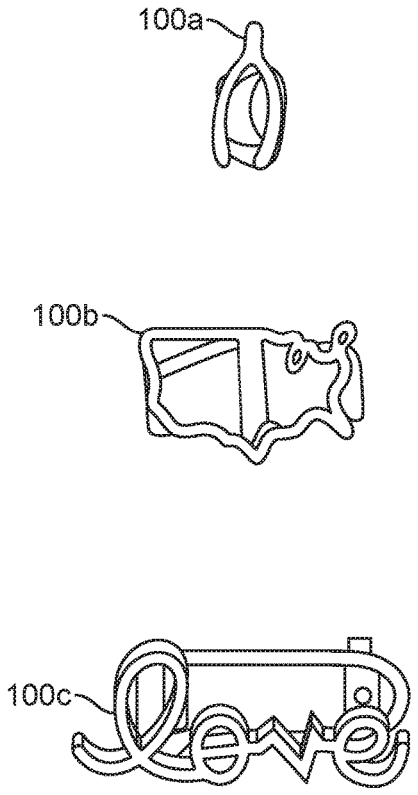
FIGS. 1A-1B show examples of front sides and back sides of keepsakes in accordance with an embodiment of the invention.
Figure 1B:
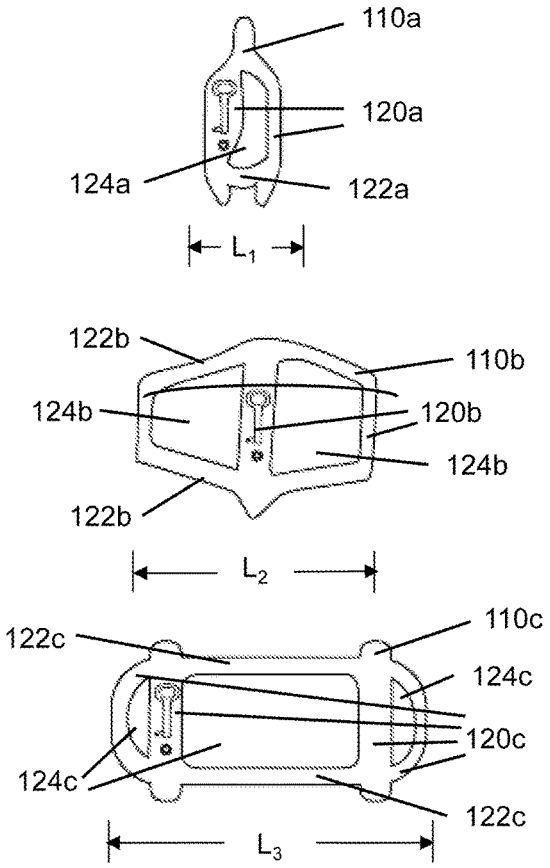

FIGS. 1A-1B show examples of front sides and back sides of keepsakes in accordance with an embodiment of the invention. Keepsakes may slide onto an elongate member. The elongate member may form a portion of jewelry. Any description herein of jewelry may apply to bracelets, wristbands, mesh bracelets, bangles, pendants, chokers, anklets, belts, earrings, or any other type of jewelry or accessory. Any mention herein of jewelry may apply to any type of jewelry or accessory, as described herein. Any mention of any specific type of accessory may apply to any other type of accessory, or any other type of jewelry. Elongate members may refer to any portion of any type of jewelry and/or accessories as described herein. Elongate members may form a base or substrate onto which the keepsakes may slide.

FIG. 1A shows front sides 100*a*, 100*b*, 100*c* of the keepsakes and FIG. 1B shows back sides 110*a*, 110*b*, 110*c* of the keepsakes. Keepsakes may also be referred to as charms, keep keys, keepers, or trinkets.

Keepsakes may have a front side 110*a*, 110*b*, 110*c* which may show decorative portions of the keepsakes. Various keepsakes may have different designs. In some embodiments, the keepsakes may have front sides of different dimensions, shapes, materials, and/or types. For example, a keepsake may have a relatively short length 100*a*, or may have a greater length 100*b*, 100*c*. In some embodiments, a keepsake front side length may be less than its width. In other instances, a keepsake front side length may be about equal to or greater than its width. The width of the keepsake may be greater than a width of an underlying elongate member.

A keepsake may have any type of shape. A keepsake may have a polygonal shape (e.g., circle, ellipse, triangle, quadrilateral, rectangle, pentagon, hexagon, octagon). A keepsake may have a regular or irregular shape. In some instances, the keepsake may have a shape of an object, such as a wishbone 100*a*, key, car, shoe, heart, star, crescent, stick figure, house, purse, musical note, flower, cat, dog, horse, or any other type of object. In some embodiments, the keepsake may have the shape of a letter or number. The keepsake may be formed of a solid piece or may be a cut-out 100*b* that may include an open space therein. For example, the keepsake may be an outline of a shape, such as the United States. In some instances, the keepsake may spell out entire words 100*c*. In some instances, the keepsake may have a solid front side with words etched or engraved into the front face.

Keepsakes may optionally have similar widths to one another. Keepsakes that will be placed on elongated members of the same or substantially similar width may have the same or similar widths.

Keepsakes may be made from any material. For example, keepsakes may be made from metal. This may include silver, gold, brass, copper, platinum, palladium, rhodium, titanium, steel, aluminum, nickel, iron, zinc, or any combination or alloy thereof. In some instances, the keepsakes may be plated or coated with a material, such as a metal. Techniques such as electroplating, ion plating, or other techniques may be used. Keepsakes may be made from other materials or may include other materials, including but not limited to, wood, precious or semi-precious stones (e.g., diamonds, rubies, emeralds, sapphires, onyx, opal, quartz, amethyst, jade), glass, crystal, enamel, polymers, rubber, or any other materials. Single types of materials or combinations of materials may be provided. The various materials may provide color and/or texture.

A surface of a keepsake may be relatively flat. In some instances, a surface of a keepsake may be textured. In some instances, a surface of a keepsake may not need to be flat and may include protrusions.

Keepsakes may have back sides 110*a*, 110*b*, 110*c* that may help keep the keepsake attached to an elongate member. Elongate members may have a front face and an opposing back face. In some instances, elongate members may be substantially flat. Front sides of keepsakes may contact a front face of an elongate member. Back sides of keepsakes may contact a back face of the elongate member. Back sides of keepsakes may extend along the width of the elongate member.

Examples of elongate members may include jewelry or accessory bases, such as wristbands, bangles, mesh bracelets, pendants, chokers, earrings, anklets, belts, headbands, shoes (e.g., sandals), gloves, glasses/sunglasses, pet-collars, keychains, or any other type of jewelry or accessory. Elongate members may include a band format where a width is substantially greater than a thickness of the elongate member. For instance, an elongate member may that has a width to thickness ratio of at least 20:1, 15:1, 10:1, 8:1, 6:1, 5:1, 4:1, 3:1, or 2:1. Alternatively, the elongate member may have any other form factor, such as chains, braids, wire, or cord. For instance, keepsakes may slide onto a bracelet, necklace, anklet, or any other type of jewelry or accessory described herein formed of chains, braids, wire, or cord. The elongate member may include any length of substrate onto which a keepsake may slide. The elongate members may be substantially flat or may be substantially curved. The elongate members may be flexible to move between a flat or curved shape. Alternatively, the elongate members may be fixed in a curved or flat shape.

In some embodiments, back sides may wrap all the way around a back face of an elongate member. For example, an entire circumference of a cross-section of an elongate member may be encircled by the keepsake. The back side may have a width that is greater than a width of the elongate member. The back side may have a portion that may cover sides of the elongate member.

The back sides may have a length L. For instance, back sides 110*a*, 110*b*, 110*c* may have varying lengths L1, L2, L3 that may correspond to length of the front sides 100*a*, 100*b*, 100*c*. Different lengths of keepsakes may have different lengths of back sides. This may advantageously permit the keepsake to lie flush against an elongate member. This may cause the elongate member to correspond to the profile of the keepsake and prevent corners or sides of the keepsakes from protruding.

In some instances, depending on the length of the keepsake, any number of cross-bars 120*a*, 120*b*, 120*c* may be provided. The cross bars may keep the keepsakes flush against the elongate members. In some instances, one, two, three, four, five, six, seven, eight, or more cross bars may be provided on a back side of a keepsake. In some instances, keepsakes having a greater number of lengths may have a greater number of cross bars. For example, relatively short keepsakes (e.g., keep sakes with a greater width than length) may have one or two cross bars. In another example, keepsakes spelling out words may have three, four, or five cross bars.

The back side may be formed from a single integral piece. The backside may be substantially flat. In some instances, the features of the back side, including any cross bars extending along the width of the keepsake and any side or extension features of the backside may all be formed form a single integral piece, or may form a substantially planar surface. In some embodiments, a cross bar 120*a*, 120*b*, 120*c* may substantially have a first orientation while the side or extension features 122*a*, 122*b*, 122*c* may have a substantially second orientation. The second orientation may be substantially perpendicular to the first orientation. For example, the cross bar may be oriented in a substantially vertical orientation with respect to a base when the keepsake is on the base (where the vertical orientation is substantially parallel to a width of the base). The side or extension features may have a substantially horizontal orientation with respect to the base when the keepsake is on the base. The surface of the back side may be substantially continuous and uninterrupted. In some instances, holes 124*a*, 124*b*, 124*c* may be provided on the back side, but the back side surface may be connected as a single piece. One or more holes may be surrounded by at least one cross bar and at least one side or extension feature. In some instances, a single hole may be provided, or multiple holes may be provided on the back side. A connected single piece back side may include at least one cross bar primarily traversing a width of a base and at least one side or extension member primarily traversing a direction parallel to the length of a base when the keepsake is on the base. The connected single piece back side may extend along the entire length of the front side or beyond the length of the front side of the keepsake.

Figure 2A:
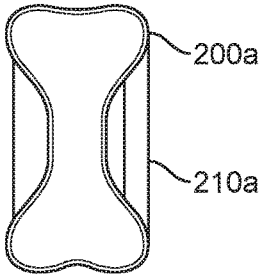
FIGS. 2A-2H show additional views of keepsakes in accordance with an embodiment of the invention.
Figure 2B:
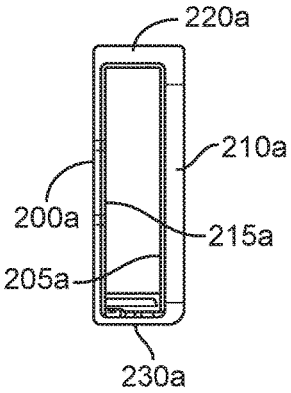
Figure 2C:
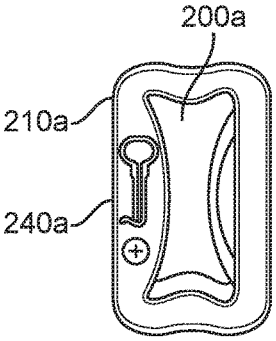
Figure 2D:
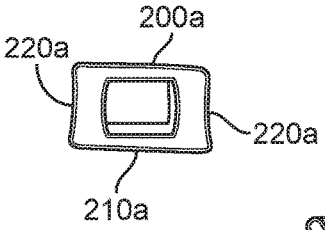

FIGS. 2A-2H show additional views of keepsakes in accordance with an embodiment of the invention. FIG. 2A shows a front side of an example of a keepsake. FIG. 2B shows a side view of an example of a keepsake. FIG. 2C shows a back side of the keep sake. FIG. 2D shows a top side of the keepsake.

As previously described, a keepsake may have any form factor or design. A keepsake may be provided on an elongate member, such as a jewelry base. The front side 200*a* of a keepsake may contact a front face of an elongate member. The back side 210 may contact a back face of an elongate member. When the keepsake is on the elongate member, the back side of the keepsake may be substantially not visible when viewing the front face of the elongate member and/or the front side of the keep sake may be substantially not visible when viewing the back face of the elongate member.

The back side 210*a* of the keepsake may have any form factor or shape. The back side of the keepsake may have a length selected based on the length of the front side 200*a*. The back side may have one, two, three, four or more cross bars extending along the width of the backside. The back side may have one or more openings or cut-outs in the back side. The back side may have a substantially rounded shape or rounded corners. In some instances, the back side may have a space for branding or a logo 240*a*.

The front side 200*a* and the back side 210*a* may be substantially parallel to one another. In some instances, an inner surface of the front side 205*a* (e.g., the side to contact an elongate member) may be substantially parallel with an inner surface of the back side 215*a* (e.g., the side to contact an elongate member). The inner surface of the front side and the inner surface of the back side may be substantially flat and/or planar. Alternatively, the inner surface of the front side and/or the inner surface of the back side may include curves, bumps, grooves, or any other surface features. The inner surfaces of the front side and the back side may be configured to permit the keepsake to slide over the elongate member. In some instances, the inner surfaces may be configured to permit the keepsakes to frictionally fit on the elongate member and prevent unwanted sliding.

Optionally, an outer surface of the front side and an outer surface of the back side may be substantially flat and/or planar. The outer surface of the back side may be parallel to an inner surface of the back side. The outer surface of the front side may be parallel to an inner surface of the front side. In other instances, the outer surface of the front side and/or outer surface of the back side need not be flat and/or may include variations to the surface. The outer surfaces may or may not be parallel to the inner surfaces.

The front side and the back side of the keepsake may be substantially planar. The front and back sides may be on substantially parallel separate planes. The front side may have a length extending along a first plane while the back side may have a greater length extending along a second parallel plane. The front and back sides may overlap when viewed from a perspective orthogonal to the first plane or the second plane.

A top side 220*a* and/or bottom side 230*a* may be provided on a keepsake. The top side may be a bar that may extend between the front side 200*a* and the back side 210*a* of the keepsake. The top side may include one, two, three, four, or more bars. Alternatively, the top side may be a single solid piece. The bottom side may be a bar that may extend between the front side and the back side of the keepsake. The bottom side may include one, two, three, four, or more bars. Alternatively, the bottom side may be a single solid piece. In some instances, the same number of bars may be provided between the top and bottom sides. Alternatively, the number of bars between the top and bottom sides may be different. The number and/or arrangement of top and/or bottom side bars may be selected based on a geometry and/or layout of the front side and/or back side. The number and/or arrangement of the top side bars may be selected without regard to the number of the bottom side bars and vice versa.

Figure 2E:
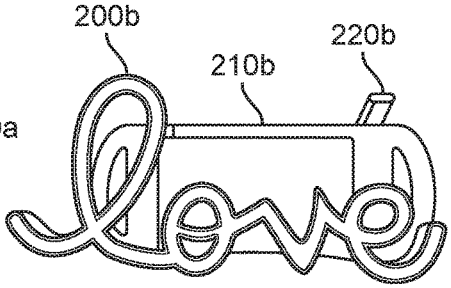
Figure 2F:
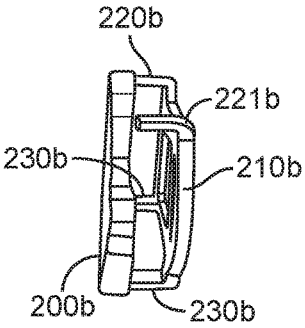
Figure 2G:
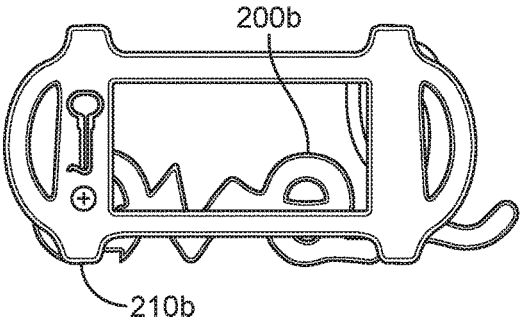
Figure 2H:
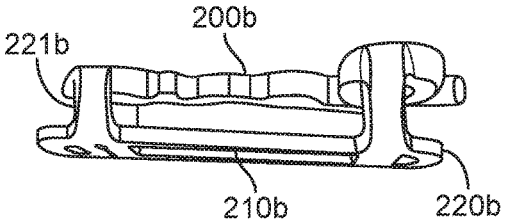

FIG. 2E shows a front side of another example of a keepsake. FIG. 2F shows a side view of the other example of a keepsake. FIG. 2G shows a back side of the other example of a keepsake. FIG. 2H shows a top side of the other example of a keepsake.

A front side 200*b* of the keepsake may be connected to a back side 210*b* of the keepsake via one or more top side 220*b* and/or bottom side 230*b* bars. The cross-section of the keepsake may be substantially rectangular. The inner surfaces of the cross-section of the keepsake may be substantially rectangular. A width of a keepsake may be greater than its thickness. A width of a keepsake may or may not be greater than its length. The cross-section of the keepsake may have substantially rounded corners. In some instances, the inner surface of the cross-section and/or the outer surface of the cross-section of the keepsake may have substantially rounded corners.

In some embodiments, one or more of the top side and/or bottom side bars of the keepsake may not connect to both the front side and the back side. For example, a top side bar 221*b* may substantially cover the thickness of an elongate member, but not contact a front face of the elongate member. One or more top side and/or bottom side bars may form extensions that may at least partially hook over a side of an elongate member.

In some embodiments, the front side and the back side of the keepsake may be formed as an integral single piece. In some instances, the front side, back side, top side, and bottom side of the keepsake may be formed as a single integral piece. Alternatively, one or more pieces may be attached to one another to form the front side, back side, top side and bottom side. A single integral piece may be provided to form the base of the keepsake including at least a portion of the front side, back side, top side, and bottom side. Optionally additional pieces may be added to the front side or back side for decorative or branding purposes.

Figure 3:
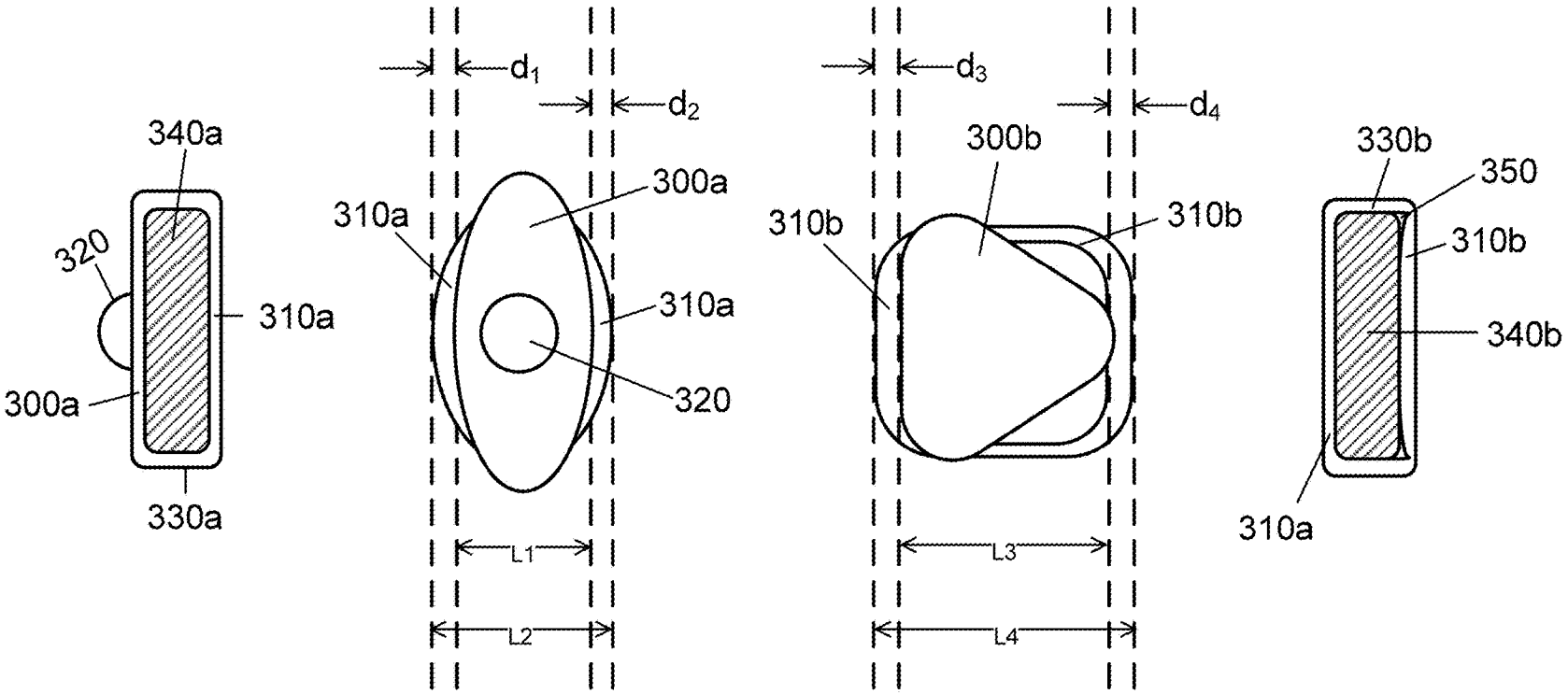
FIG. 3 shows schematics of keepsakes where back sides of the keepsakes extend beyond a length of front sides of the keepsakes, in accordance with an embodiment of the invention.

FIG. 3 shows schematics of keepsakes where back sides of the keepsakes extend beyond a length of front sides of the keepsakes, in accordance with an embodiment of the invention.

A keepsake may have a front side 300*a*, 300*b* and a back side 310*a*, 310*b*. The front side may optionally be a decorative side while the back side may optionally be a support side. In alternative embodiments, the back side may be decorative as well. In some instances, the front side may include decorative features 320, such as stones that may protrude, or have decorative shapes or designs. One or more top or bottom sides 330*a*, 330*b* may be provided that may connect the front side to the back side. In some instances, both top and bottom sides are provided. In alternate embodiments, only a top side or a bottom side is provided.

A keepsake may be mounted onto a jewelry substrate 340*a*. The jewelry substrate may be an elongate member. The jewelry substrate may be a band. The jewelry substrate may form a base for the keepsakes and may have a flat and/or elongated shape. Examples of jewelry substrates may include various jewelry or accessories, such as, but not limited to, bracelets, wristbands, mesh bracelets, bangles, pendants, chokers, anklets, belts, earrings, headbands, or any other type of jewelry or accessory. The jewelry substrates may have a shape where one or more keepsakes may slide onto the jewelry substrates. The jewelry substrates may be shaped and/or sized to accommodate a single keepsake. The single keepsake may be swapped out with other keepsakes. In other instances, the jewelry substrates may be shaped and/or sized to accommodate multiple keepsakes. For example, multiple keepsakes of the same design or different designs may be added to the jewelry substrates. Further examples of various types of jewelry substrates with keepsakes mounted thereon are described in greater detail elsewhere herein.

In some embodiments, a keepsake may be configured such that when a cross-section if taken of a keepsake on a jewelry substrate 340*a*, 340*b*, the front side 300*a*, 300*b*, back side 310*a*, 310*b*, top side, and bottom side 330*a*, 330*b* all wrap around the jewelry substrate. The entirety of a cross-section of at least a portion of the jewelry substrate may be entirely surrounded by the keepsake. In some instances, when the keepsake is projected onto a plane parallel to the cross-section of the jewelry substrate, the entirety of a cross-section of at least a portion of the jewelry substrate may be entirely surrounded by the keepsake projection. There may be at least some overlap between a back side and a front side of the keepsake.

A keepsake may have a length $L_1$ of its front side and a length $L_2$ of its back side. Similarly, a keepsake may have a length $L_3$ of its front side and a length $L_4$ of its back side. A front side and a back side of a keepsake may have different lengths. In some instances, the front side of the keepsake may have a lesser length than the back side of the keepsake (e.g., $L_1<L_2$, $L_3<L_4$). The length of a back side of a keepsake may extend beyond a length of a front side of a keepsake. The length of the back side may extend beyond a length of a front side of a keepsake on a single side (e.g., right side or left side) or on both sides (e.g., right side and left side). The back side may be configured such that the back side is on a different plane than the front side. The back side and front side planes may be substantially parallel to one another. The back side may extend beyond the length of the front side on at least one side (e.g., right side, left side) on the back side plane that is different from the front side plane.

In some instances, a distance $d_1$, $d_2$, $d_3$, $d_4$ may be provided for which the back side extends beyond the front side of the keepsake. In some instances, the distance may be a small amount, such as about 1 cm or less, 5 mm or less, 4 mm or less, 3 mm or less, 2 mm or less, 1.5 mm or less, 1 mm or less, 0.5 mm or less, or 0.1 mm or less. In some instances, both sides of the keepsake may have a back side that extends beyond the length of the front side. Alternatively, a single side or neither side may have a back side that extends beyond the length of the front side. The various distances on each side may be the same, or may be different from one another.

Having a greater length on the back side may prevent the front sides of the keepsakes from coming into contact with one another or overlapping one another when they are mounted on the same jewelry substrate. For example, if multiple keepsakes are slid onto a jewelry substrate, the back sides may keep the front sides spaced apart. This may be advantageous for preventing keepsakes from bunching up in the front and becoming mis-aligned. Furthermore, this may also provide a clean presentation for aesthetic reasons. The keepsakes may be spaced apart so that pushing on one keepsake along the jewelry substrate may cause the adjacent keepsake to be pushed along so that a space remains between the front faces of the keepsakes.

The back side may be shaped such that the back side extends beyond the longest or outermost portion of the front side. Alternatively, in some embodiments, the front sides may be shaped so that a portion extends beyond the longest or outermost portion of the back side. The front sides may be shaped or arranged so that they are unlikely to bump into adjoining keepsakes. Thus, even if a front side has an extension extending beyond the back side, it may not overlap with or bump into a front side of an adjacent keepsake. Alternatively, it may contact the front face of the adjacent keepsake.

In some embodiments, when a keepsake is slid onto a jewelry substrate 340*a*, 340*b*, the substrate may be substantially flush against all the inner surfaces of the sides of the keepsake. The substrate may be flush against the front 300*a*, 300*b* and back 310*a* side inner surfaces. In other instances, one of the sides, such as the back side 310*b* or a front side may have a curvature or other feature. The curvature or other feature may cause sufficient frictional contact between the jewelry substrate and the inner surface of the keepsake to prevent unwanted sliding, while permitting the keepsake to be slid on when sufficient force is applied. In some instances, some gaps 350 or spaces may be provided between the jewelry substrate and an inner surface of a side, such as a front side or back side.

In some instances, the jewelry substrate may be flush with a top side and/or bottom side 330*a*, 330*b* of the keepsake. This may prevent the keepsake from substantially rotating relative to the jewelry substrate. The keepsakes may be prevented from rotating about an axis that is perpendicular to a face of the jewelry substrate. Similarly, the keepsakes may be prevented from rotating about an axis extending along a length of the jewelry substrate. The keepsakes may remain at a substantially stationary orientation relative to the jewelry substrate. In alternate embodiments, there may be some space or a gap between a side of the jewelry substrate and the top side and/or bottom side 330*a*, 330*b* of the keepsake. This may permit some rotating about any of the axes described herein. There may be some angular "wiggle" that may be permitted for the keepsakes.

Figure 4B:
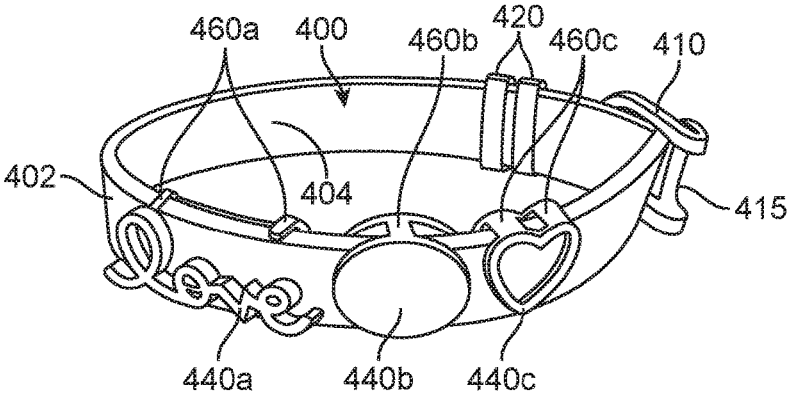
FIGS. 4A-4D show examples of a wristband and keepsakes on the wristbands in accordance with an embodiment of the invention.
Figure 4A:
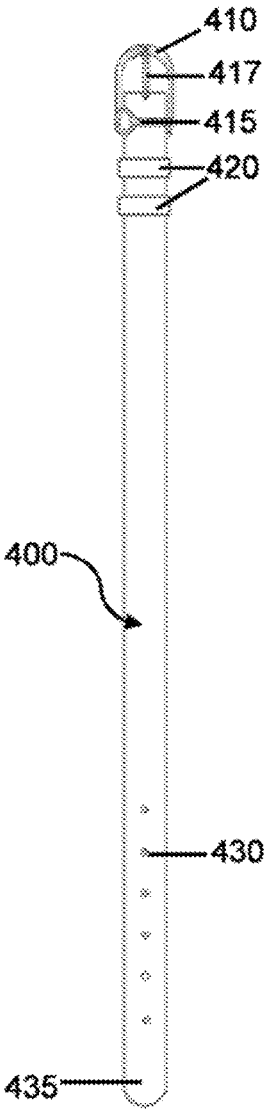

FIGS. 4A-4D show examples of a wristband and keepsakes on the wristbands in accordance with an embodiment of the invention. FIG. 4A shows an example of a wristband 400. A wristband may be provided as an example of a jewelry substrate. A wristband may be an elongate member on which keepsakes may be applied. The wristband may include a buckle 410 which may aid in keeping wristband closed. The buckle may include a cross bar component 415. In some instances, the cross bar component may be a portion where a logo or branding may occur. One or more straps 420 may be provided that may also aid in keeping an end of the wristband flush against a surface of the wristband. Optionally, the wristband may include one tongue 417 that may be part of the buckle. One or more holes 430 may be provided that may receive the tongue of the buckle and help lock the wristband at a particular closed length. In other instances, no tongue or holes are provided and the end of wristband may be inserted into the buckle and kept in place using the straps. A friction fit may be sufficient to keep the wristband closed.

The wristband may be reversible. The wristband may have a first face and an opposing second face. The first face may have a first set of characteristics and the second face may have a second set of characteristics. At least some of the second set of characteristics may be different from the first set of characteristics. For instance, a characteristic may be color. A first face of a wristband may be of a first color while a second face of the wristband may be of a second different color. For instance, one face of the wristband may be beige, while another face of the wristband may be green. In another example, a characteristic may be texture. A first face of a wristband may have a first texture while the second face of a wristband may have a second texture that may be different from the first texture. For instance, one face of the wristband may have a smooth texture, while another face of the wristband may have a bumpy or rough texture. Another example of a characteristic may be finish. For example, a first face of a wristband may have a first finish while a second face of the wristband may have a second finish that is different from the first finish. For instance, one face of the wristband may be shiny (e.g., patent), while another face of the wristband may be brushed, matte or dull. Another example of a characteristic may include material. A first face of a wristband may include a first material while a second face of the wristband may include a second material that is different from the first material. For example, one face of the wristband may include leather while another face of the wristband may include fabric. Other examples of characteristics may be provided. In some instances, all characteristics between the different faces may be different, all characteristics between the different faces may be the same, or one or more characteristics between the different faces may be different while other characteristics may be the same.

This may be useful for a reversible wristband 400. The wristband may be worn so that the first face is directed outward, or so that the second face is directed outward. Thus, the first set of characteristics (e.g., color, texture, finish, material) may be exposed when the wristband is worn with the first face directed outward. The second set of characteristics (e.g., color, texture, finish, material) may be exposed when the wristband is worn with the second face directed outward. For example, a wristband may be reversible so that in a first configuration, a beige face is directed outward, and in a second configuration, a green face is directed outward.

The buckle 410 may be configured so that the wristband 400 can be locked in either configuration. The buckle may be configured so that an end 435 of the wristband overlies the portion of the wristband that is close to the buckle. The end of the wristband may be kept in place by the straps 420 so that the end of the wristband is exposed as an outer surface of the wristband when closed. The end of the wristband may be on the outer surface of the wristband regardless of the face that is selected to be the outer face. Thus, the wristband may be reversible and locked in the same manner even in different configurations.

In some embodiments, the buckle 410 may be configured to permit the wristband to lock in either direction. The buckle may be substantially symmetrical about a pivot point of the buckle. In some instances, the buckle may include a loop portion and a cross bar 415 portion. Both the loop and cross bar may be movable when the buckle is pivoted about its pivot point. Both the loop and the cross bar may be formed from a single integral piece and may be some distance away from the pivot point. In some instances, the loop and cross bar as shown may have different shapes or configurations. Alternatively, they may have the same shape or configuration (e.g., both may be cross bars or both may be loops). The loop and cross bar may extend the same distance away from the pivot point, or may extend different distances away from the pivot point. A tongue 417 of the buckle may pivot to contact the loop portion or the cross bar portion. The tongue may pivot about the same axis as the rest of the buckle. Permitting movement of the loop portion and the cross bar portion may permit the end 435 of the wristband to be inserted into the buckle from either end, thus allowing easy closure of a reversible wristband.

Keepsakes may be slid onto the wristband 400. The keepsakes may be slid onto the wristband while the wristband is in an open configuration. The keepsakes may not slide off when the wristband is closed. Keepsakes may slide onto or off the wristband through the open end 435 of the wristband. The buckle 410 may prevent the keepsakes from sliding on or off through the buckle end. The faces of the wristband may be substantially flat. The keepsakes may have a correspondingly flat form factor that may prevent the keepsakes from twisting or rotating around an axis that extends along the length of the wristband.

In some instances, the wristband may be formed from leather, faux-leather, string, rope, fabric, textiles, ribbon, plastic, silicone, rubber, glass, or similar material that may be semi-rigid. The wristband may be formed from multiple layers attached to one another. The wristband may include materials that are braided, knotted, twisted, layered, embedded, or adjacent to one another. In some instances, different faces of the wristband may be dyed or finished differently. Different portions or lengths of the wristbands may be formed from different materials. Any description herein relating to wristband materials may apply to any type of jewelry substrate.

Figure 15:
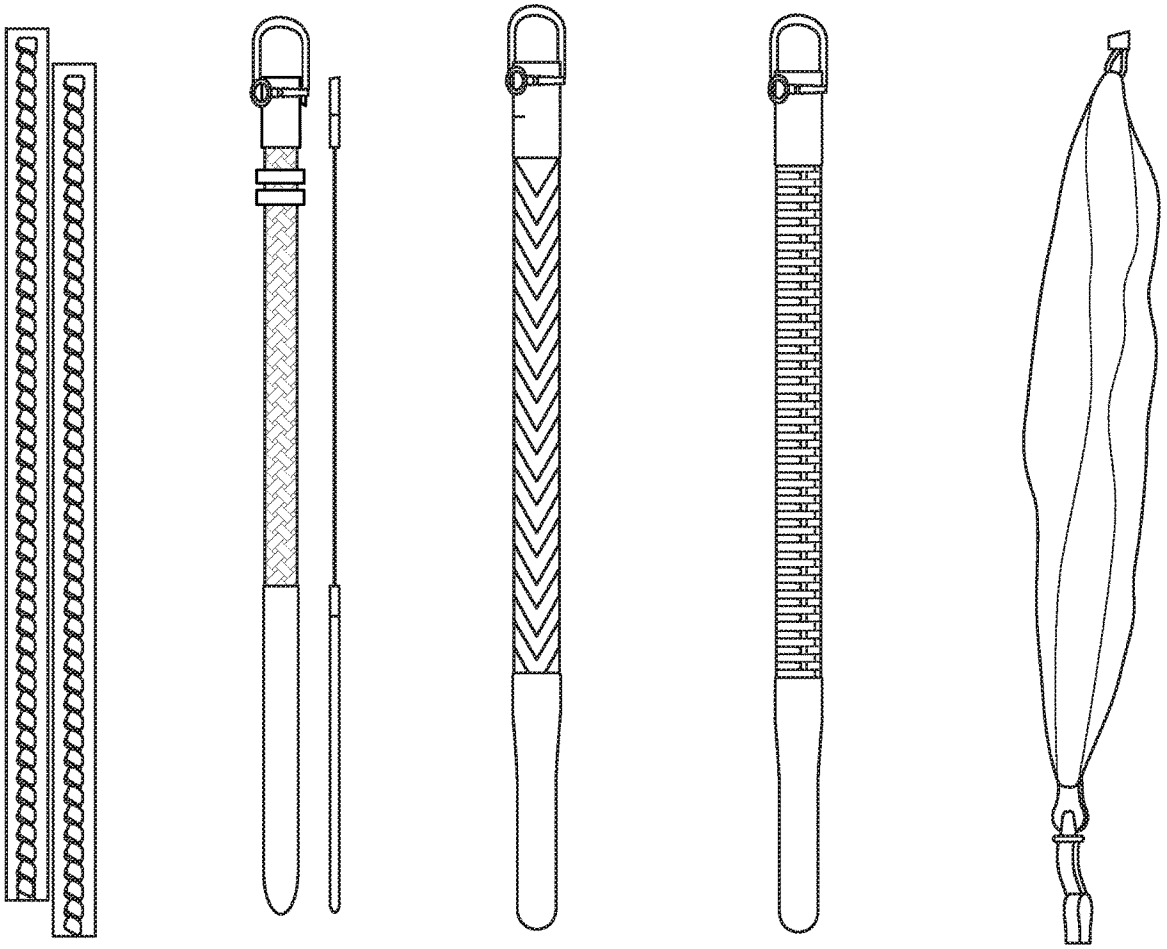
FIG. 15 provides several examples of jewelry substrates, such as wristbands.

FIG. 15 provides several examples of jewelry substrates, such as wristbands. These may include jewelry substrates of various materials and/or a combination of materials. The materials may change along the length of the jewelry substrate.

FIG. 4B shows an example of a wristband 400 with a first face 402 as an outer face, and keepsakes mounted thereon. A second opposing face 404 may be an inner face of the wristband. A buckle 410 which may have a cross bar 415 may keep the wristband closed, with further aid of one, two or more straps 420. The keepsakes may be mounted on the wristband so that front sides 440*a*, 440*b*, 440*c* of the keepsakes are facing outward. The front side of the keepsakes may be on an outer face of the wristband. In the embodiment provided herein, the front side of the keepsakes may contact a first face of the wristband. In some instances, when viewing the front faces of the keepsakes, they may be spaced apart and not contacting one another. In alternative embodiments, some contact may be provided between the front faces of the keepsakes. Top sides 460*a*, 460*b*, 460*c* and/or bottom sides may be provided that may cover the side edges of the wrist bands.

The wristband may be formed from a flexible material. The wristband may be formed from a semi-rigid material. The wristband may be able to conform its curvature to match a profile of a keepsake. The wristband and keepsakes may be sized and/or shaped so that the keepsakes slide on the wristband when sufficient force is applied. However, there may be sufficient friction so that the keepsakes may remain on the wristband without sliding around when no external force is applied. When an individual is wearing the wristband, there may be sufficient friction to keep the keepsakes from sliding around. When an individual grasps a keepsake and pulls or pushes with sufficient force, the keepsakes may slide along the wristband. The wristband and keepsakes may be dimensioned so that the keepsakes remain substantially upright and do not wriggle.

The wristband may have any dimensions. For example, the width of the wristband may be greater than or equal to about 3 mm, 5 mm, 6 mm, 7 mm, 8 mm, 9 mm, 1 cm, 1.1 cm, 1.2 cm, 1.3 cm, 1.5 cm, 1.7 cm, 2 cm, 2.5 cm or 3 cm. The width of the wristband may be less than any of the dimensions described. The width of the wristband may fall into a range between any two dimension values described herein. Such dimensions are provided by way of example only and are not limiting. The wristband and/or keepsakes may be dimensioned to permit the keepsakes to slide on and to stay on. The dimensions may be provided to prevent unwanted sliding of the keepsakes. In some instances, a thickness of the wristband and a thickness of the opening of the keepsakes may differ by less than 1 mm, 0.5 mm, 0.1 mm, 0.05 mm, or 0.01 mm. Optionally, a thickness of the wristband and a thickness of the opening of the keepsakes may differ by less than 5%, 3%, 1%, 0.5%, 0.1%, 0.05%, or 0.01% of the thickness of the wristband. In some instances, the wristband material may be slightly resilient, which may permit the wristband to squished within the opening of the keepsakes when the keepsakes slide on. In some instances, the thickness of the wristband may be slightly greater than a thickness of the keepsake opening. Alternatively, the thickness of the wristband may be less than or equal to the thickness of the keepsake opening.

The keepsakes may have different decorations and/or dimensions. An individual may advantageously be able to personalize their wristband with selected keepsakes. The individual may also be able to select the order the keepsakes are applied and be able to add or subtract keepsakes, or swap them for other keepsakes.

Figure 4C:
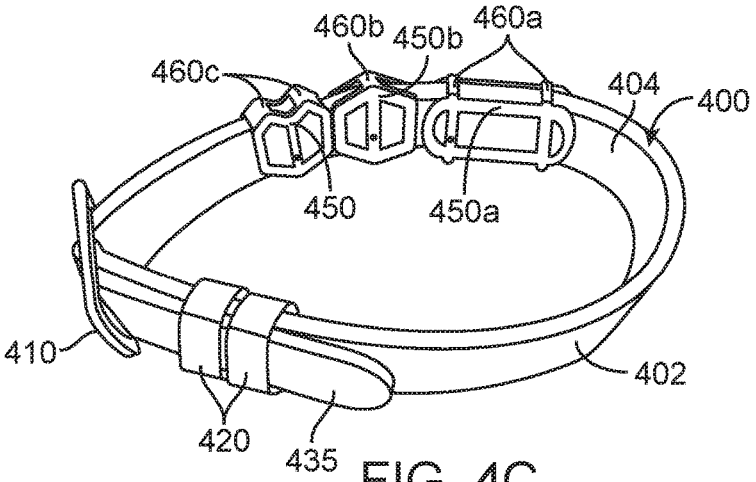

FIG. 4C shows a rear view of the wristband with a first face 402 as the outer face and keepsakes mounted thereon. As shown, the first face may be exposed when an individual is wearing the wristband. A second face 404 may be an inner face. The inner face may contact the wearer's wrist. The inner face may not be substantially exposed when the individual is wearing the wristband.

The keepsakes may have rear sides 450*a*, 450*b*, 450*c*. The rear sides may extend along the entire width of the wristband. The rear sides may be connected to the front sides 440*a*, 440*b*, 440*c* via top sides 460*a*, 460*b*, 460*c* and/or bottom sides. In some instances, the rear sides may have greater lengths than the front sides. Optionally, the rear sides may have a length extending beyond a length of the front side. This may permit the rear sides to come into contact with one another as shown in FIG. 4C while maintaining spacing between the front sides as shown in FIG. 4B. The shape of the rear sides may be selected based on the shape of the front sides. The shape of the rear sides may or may not roughly track the shapes of the respective front sides.

Figure 4D:
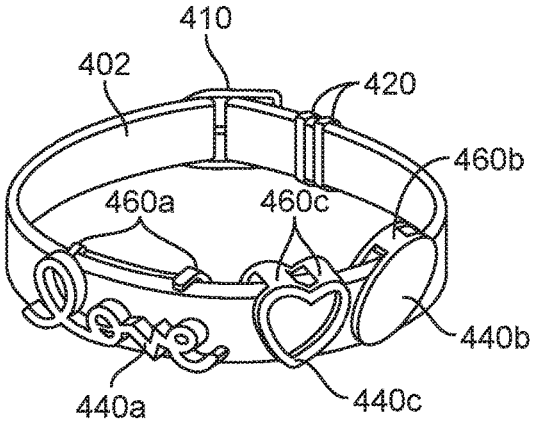

FIG. 4D shows an example of a wristband with a second face 404 as an outer face, and keepsakes mounted thereon. The first face 402 may be reversed to be the inner face. Thus, the second face may be exposed when the wristband is worn by an individual.

When the wristband has been reversed, the front sides 440*a*, 440*b*, 440*c* of the keepsakes may contact the second face of the wristband. In one instance, the first face may be a beige face while the second face may be a green face. When the wristband is in the first configuration as shown in FIG. 4B, the beige face may be exposed. When the wristband is in the second configuration as shown in FIG. 4D, the green face may be exposed. In both the first and second configurations, it may be equally easy to close the wristband. The end of the wristband may be inserted through the buckle 410 and held against the outer face of the wristband by the straps 420 regardless of the configuration.

When changing configuration from a first configuration to a second configuration, the keepsakes may be removed from the wristband, and then flipped so that the front face of the keepsakes contact the second face of the wristband instead of the first face of the wristband. The keepsakes may be slid off of the wristband. Then the keepsakes may be rotated 180 degrees so that the front face of the keepsakes align with the second face of the wristband. Then the keepsakes may be slid back onto the wristband. Thus, in the second configuration, both the keepsakes and the second face of the wristband may be on the outer side.

This reversibility may add an additional layer of personalization to the wristband. A wearer may be able to select between different colors and wear the wristband with an equal layer of comfort. This may increase the versatility of the wristband (e.g., matching different outfits). The same keepsakes may be used between different reversible configurations, or may be swapped out for other keepsakes.

Figure 5A:
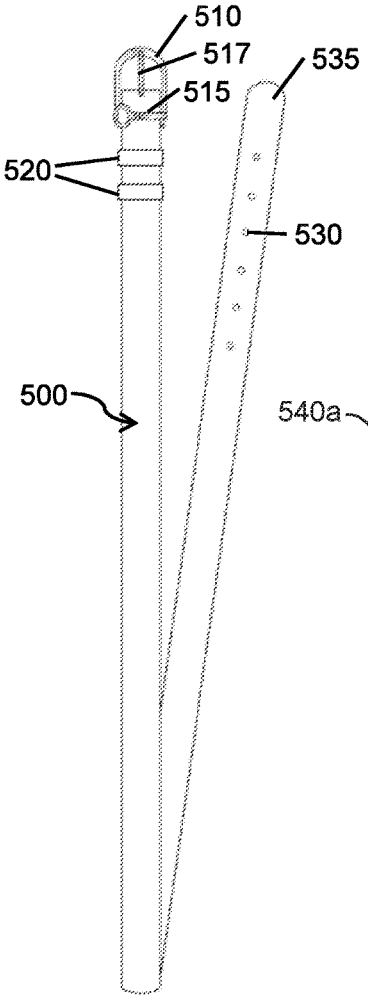
FIGS. 5A-5B show examples of a multi-wrap wristband and keepsakes on the wristbands in accordance with an embodiment of the invention.
Figure 5B:
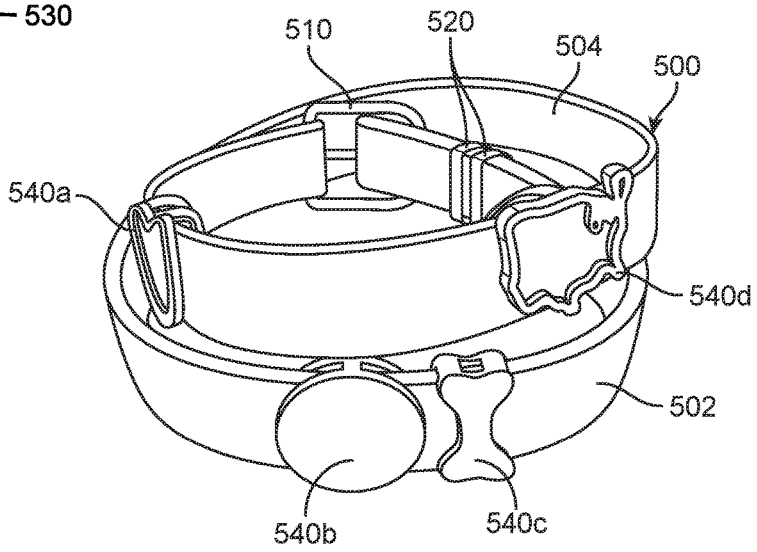

FIGS. 5A-5B show examples of a multi-wrap wristband and keepsakes on the wristbands in accordance with an embodiment of the invention. FIG. 5A shows an example of a multi-wrap wristband 500. A multi-wrap wristband may have any characteristic of a wristband 400 as described elsewhere herein. In some instances, the multi-wrap wristband may be sufficiently long to wrap around a wrist of an individual multiple times. For instance, the multi-wrap wristband may be long enough to wrap around the wrist of an individual two, three, four, five, six or more times.

A multi-wrap wristband may be provided as an example of a jewelry substrate. A multi-wrap wristband may be an elongate member on which keepsakes may be applied. The multi-wrap wristband may include a buckle 510 which may aid in keeping wristband closed. The buckle may include a cross bar component 515. In some instances, the cross bar component may be a portion where a logo or branding may occur. One or more straps 520 may be provided that may also aid in keeping an end of the wristband flush against a surface of the wristband. Optionally, the wristband may include one tongue 517 that may be part of the buckle. One or more holes 530 may be provided that may receive the tongue of the buckle and help lock the wristband at a particular closed length. In other instances, no tongue or holes are provided and the end 535 of wristband may be inserted into the buckle and kept in place using the straps. A friction fit may be sufficient to keep the wristband closed.

The wristband 500 may or may not be reversible. In some instances, a first face and a second opposing face of the wristband may have the same characteristics. Alternatively, the first face and the second face may have at least one set of different characteristics. The buckle 510 may be configured such that the user can comfortably open and close the wristband when the multi-wrap wristband has the first face facing outwards, and when the multi-wrap wristband has the second face facing outwards. In both these scenarios, the buckle configuration may be substantially the same. The open end 535 of the wristband may pass through the buckle and be held down with the aid of the straps 520, overlapping the outer surface of the wristband.

FIG. 5B shows an example of the multi-wrap wristband 500 with keepsakes mounted thereon. A wristband may have a first face 502 as an outer face. A second opposing face 504 may be an inner face of the wristband. In some embodiments, the wristband may be reversible so the configuration of the wristband may be changed so the second face becomes the outer face and the first face becomes the inner face.

A buckle 510 which may have a cross bar 515 may keep the wristband closed, with further aid of one, two or more straps 520. The keepsakes may be mounted on the wristband so that front sides 540*a*, 540*b*, 540*c*, 540*d* of the keepsakes are facing outward. The front side of the keepsakes may be on an outer face of the wristband. In the embodiment provided herein, the front side of the keepsakes may contact a first face of the wristband in a first configuration. The front side of the keepsakes may contact a second face of the wristband in a second configuration when the wristband is reversible. In some instances, when viewing the front faces of the keepsakes, they may be spaced apart and not contacting one another. In alternative embodiments, some contact may be provided between the front faces of the keepsakes. Top sides 560*a*, 560*b*, 560*c*, 560*d* and/or bottom sides may be provided that may cover the side edges of the wristbands. In some instances, keepsakes may be directly adjacent to one another. Their back sides may contact one another. Alternatively, the keepsakes may be positioned anywhere along the length of the wristbands. The keepsakes may be spaced apart. One or more keepsakes may be positioned so they do not contact other keepsakes. In some instances, even back sides of the keepsakes do not contact one another in certain configurations.

The wristband may be formed from a flexible material. The wristband may be formed from a semi-rigid material. The wristband may be able to conform its curvature to match a profile of a keepsake. The wristband and keepsakes may be sized and/or shaped so that the keepsakes slide on the wristband when sufficient force is applied. However, there may be sufficient friction so that the keepsakes may remain on the wristband without sliding around when no external force is applied. When an individual is wearing the wristband, there may be sufficient friction to keep the keepsakes from sliding around. When an individual grasps a keepsake and pulls or pushes with sufficient force, the keepsakes may slide along the wristband. Thus, a wearer may position the keepsakes in any desired manner along the length of the wristband to create a desired visual effect. The keepsakes may remain at their position on the wristband during normal wear. The wristband and keepsakes may be dimensioned so that the keepsakes remain substantially upright and do not wriggle.

The keepsakes may have different decorations and/or dimensions. An individual may advantageously be able to personalize their wristband with selected keepsakes. The individual may also be able to select the order the keepsakes are applied and be able to add or subtract keepsakes, or swap them for other keepsakes. For multi-wrap wristbands, the keepsakes may be positioned along any layer of wrapping of the wristband. For instance, some keepsakes may have front faces displayed on a first layer 540*a*, 540*d* while other keepsakes may have front faces displayed on a second layer 540*b*, 540*c*.

Buckles 510 are provided by as an example of a type of close. Other types of closures may be used such as clasps (e.g., lobster clasps, toggle clasps), magnetic connections, threaded portions, hook and loop fastener, or other mechanisms for closing jewelry. Some of these closures may be used reversibly for reversible jewelry.

Figure 6A:
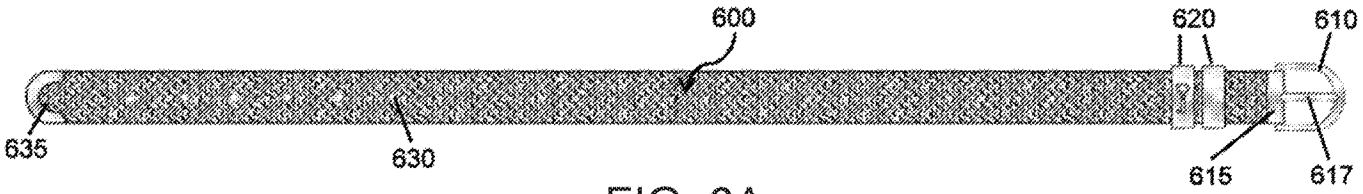
FIGS. 6A-6D show examples of a mesh bracelet and keepsakes on the mesh bracelet in accordance with an embodiment of the invention.

FIGS. 6A-6D show examples of a mesh bracelet and keepsakes on the mesh bracelet in accordance with an embodiment of the invention. FIG. 6A shows an example of a mesh bracelet. A mesh bracelet may be provided as an example of a jewelry substrate. A mesh bracelet may be an elongate member on which keepsakes may be applied. The mesh bracelet may have a relatively flat and/or planar shape. The mesh bracelet may include a buckle 610 which may aid in keeping bracelet closed. The buckle may include a base 615. The base may be attached to the body of the mesh bracelet. Alternatively, a cross-bar configuration, such as those illustrated for wristbands, may be used. One or more straps 620 may be provided that may also aid in keeping an end 635 of the bracelet flush against a surface of the bracelet. Optionally, the mesh bracelet may include one tongue 617 that may be part of the buckle. One or more holes 630 may be provided that may receive the tongue of the buckle and help lock the wristband at a particular closed length. In other instances, no tongue is provided and the end of mesh bracelet may be inserted into the buckle and kept in place using the straps. A friction fit may or may not be sufficient to keep the mesh bracelet closed.

The mesh bracelet may or may not be reversible. The mesh bracelet may have a first face and an opposing second face. In some instances, the first face and the second face of the mesh bracelet may have the same characteristics. Alternatively, the first face and the second face may have at least one set of different characteristics. The buckle 610 may be configured such that the user can comfortably open and close the mesh bracelet when the bracelet has the first face facing outwards. The buckle may or may not be configured so that the user can comfortably open and close the bracelet when the second face is facing outwards. For instance, if the mesh bracelet is not reversible, the buckle may be configured so that the user can not comfortably open and close the bracelet when the second face is facing outwards. Alternatively, if the mesh bracelet is reversible, the buckle may be configured so that the user can comfortably open and close the bracelet when the second face is facing outward. The open end 635 of the wristband may pass through the buckle and be held down with the aid of the straps 620, overlapping the outer surface of the wristband.

In some instances, the mesh bracelet may be formed from metal (e.g., silver, stainless steel, gold, platinum, titanium, rhodium, iron, brass, copper, nickel, aluminum, etc.), leather, faux leather, plastic, or similar material that may be rigid or semi-rigid. The mesh bracelet may be formed from metal or other materials that may be woven and/or linked together. The mesh bracelet may include links that may be connected to form a substantially planar jewelry substrate. The overall bracelet may be flexible. In some instances, different faces of the bracelet may be plated or finished differently.

Figure 6C:
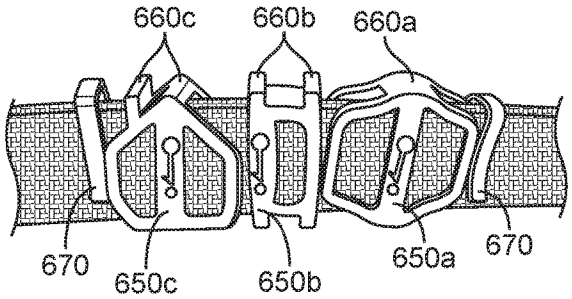
Figure 6B:
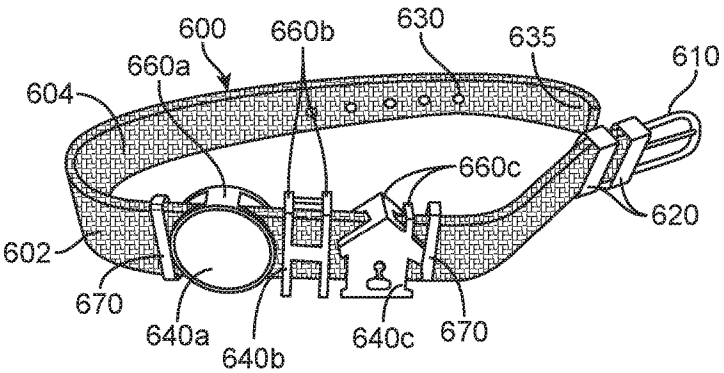

FIG. 6B shows an example of the mesh bracelet with keepsakes mounted thereon. Keepsakes may be slid onto the mesh bracelet 600. The keepsakes may be slid onto the mesh bracelet while the mesh bracelet is in an open configuration. The keepsakes may not slide off when the bracelet is closed. Keepsakes may slide onto or off the bracelet through the open end 635 of the bracelet. The buckle 610 may prevent the keepsakes from sliding on or off through the buckle end. The faces of the bracelet may be substantially flat. The keepsakes may have a correspondingly flat form factor that may prevent the keepsakes from twisting or rotating around an axis that extends along the length of the bracelet.

A mesh bracelet may have a first face 602 as an outer face. A second opposing face 604 may be an inner face of the bracelet. In some embodiments, the mesh bracelet may be reversible so the configuration of the mesh bracelet may be changed so the second face becomes the outer face and the first face becomes the inner face. Alternatively, the mesh bracelet is not reversible and the first face may remain as the outer face.

A buckle 610 may keep the mesh bracelet closed, with further aid of one, two or more straps 620. The keepsakes may be mounted on the bracelet so that front sides 640*a*, 640*b*, 640*c* of the keepsakes are facing outward. The front side of the keepsakes may be on an outer face of the bracelet. In the embodiment provided herein, the front side of the keepsakes may contact a first face of the bracelet in a first configuration. In some instances, when viewing the front faces of the keepsakes, they may be spaced apart and not contacting one another. In alternative embodiments, some contact may be provided between the front faces of the keepsakes. Top sides 660*a*, 660*b*, 660*c* and/or bottom sides may be provided that may cover the side edges of the bracelet. In some instances, keepsakes may be directly adjacent to one another. Their back sides may contact one another. Alternatively, the keepsakes may be positioned anywhere along the length of the bracelet. The keepsakes may be spaced apart. One or more keepsakes may be positioned so they do not contact other keepsakes.

The mesh bracelet may be formed from a metal or other material as described elsewhere herein. The bracelet may be able to conform its curvature to match a profile of a keepsake. The bracelet and keepsakes may be sized and/or shaped so that the keepsakes slide on the bracelet. In some instances, the keepsakes may be able to slide freely along the bracelet when worn by the user. In other instances, sufficient friction may be applied so that the keepsakes remain substantially in place while the bracelet is worn by the user. The keepsakes may slide when sufficient force is applied by a wearer. In some instances, one or more stoppers 670 may be provided. The stoppers may prevent the keepsakes from sliding around along the bracelet. In some instances, two stoppers may be used to keep one, two, three or more keepsakes at a certain position on the bracelet. The stoppers may prevent keepsakes from sliding beyond the stoppers. The keepsakes may slide freely between the stoppers if excess space is provided. The stoppers may remain substantially in place along the bracelet in the absence of an outside force. During normal wear, the stoppers may remain in place on the bracelet. When an individual grasps a stopper and pulls or pushes with sufficient force, the stopper may slide along the bracelet. Thus, a wearer may position the stoppers in any desired manner along the length of the bracelet to create stopping power and/or placement of keepsakes on the bracelet. The mesh bracelet and keepsakes may be dimensioned so that the keepsakes remain substantially upright and do not wriggle.

The keepsakes may have different decorations and/or dimensions. An individual may advantageously be able to personalize their mesh bracelet with selected keepsakes. The individual may also be able to select the order the keepsakes are applied and be able to add or subtract keepsakes, or swap them for other keepsakes.

In some embodiments, the keepsakes may be designed and/or dimensioned so that they can be used on a plurality of different types of jewelry substrates. For example, the same keepsake may be worn on a wristband and a mesh bracelet. In some instances, the keepsakes, wristband, and mesh bracelets may be dimensioned so that the keepsakes may be frictionally fit onto the wristband while more freely moving on a mesh bracelet. The dimensioning may be provided to accommodate different materials of jewelry substrates. For example, for harder or more rigid underlying jewelry substrate materials (e.g., metals, hard plastics), the keepsakes may be configured to move more freely on the jewelry substrate. Stoppers may or may not be employed to keep the keepsakes in place. For the more flexible or malleable jewelry substrate materials (e.g., leather, soft plastics), the keepsakes may be configured to be frictionally fit on the jewelry substrate. Stoppers may not be needed to keep the keepsakes in place.

This may advantageously permit greater flexibility in the user of the keepsakes. In addition to customizing a jewelry substrate with personalized keepsakes, a user may be able to customize a jewelry substrate for particular keepsakes. For example, a user may have a keepsake or set of keepsakes that the user wishes to wear with different jewelry substrates. For example, a user may wear a keepsake with a leather wristband for a more casual look, while swapping out the jewelry substrate to wear the keepsake with a mesh bracelet to provide a more dressed-up look. A user may slide a keepsake onto a first jewelry substrate. The user may wear the article of jewelry. When the user wishes to change jewelry substrates, the user may slide the keepsake off the first jewelry substrate. The user may then slide the keepsake onto a second jewelry substrate, and wear the second article of jewelry.

FIG. 6C shows a rear view of a mesh bracelet with keepsakes mounted thereon. The first face 602 may be the outer face. The first face may be exposed when the individual is wearing the mesh bracelet. A second face may be an inner face. The inner face may contact the wearer's wrist. The inner face may not be substantially exposed when the individual is wearing the bracelet.

The keepsakes may have rear sides 650*a*, 650*b*, 650*c*. The rear sides may extend along the entire width of the bracelet. The rear sides may be connected to the front sides 640*a*, 640*b*, 640*c* via top sides 660*a*, 660*b*, 660*c* and/or bottom sides. In some instances, the rear sides may have greater lengths than the front sides. Optionally, the rear sides may have a length extending beyond a length of the front side. This may permit the rear sides to come into contact with one another as shown in FIG. 6C while maintaining spacing between the front sides as shown in FIG. 6B. The shape of the rear sides may be selected based on the shape of the front sides. The shape of the rear sides may or may not roughly track the shapes of the respective front sides.

Optionally, stoppers 670 may be used to keep the keepsakes at a desired location range along the length of the mesh bracelet. The desired location range may be the space between two stoppers. A front side of the stopper may contact an outer face of the bracelet. A back side of the stopper may contact an inner face of the bracelet. The stopper may have a top surface or bottom surface. The stopper may or may not have both a top surface and a bottom surface.

Figure 6D:
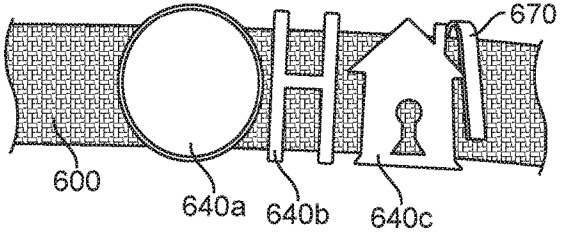
Figure 6D:
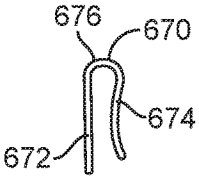

FIG. 6D shows an example of keepsakes mounted on a mesh bracelet 600 using stoppers 670. Stoppers may be added or removed from the bracelet without having to slide the stoppers onto the bracelet through an end 635 of the bracelet. The stoppers may include a front side 672, back side 674, and a connecting portion 676. The front side and back side may be substantially parallel to one another. The front side or the back side may be flat. The front side or the back side may be curved. Curvature may aid in keeping the stopper in place on the bracelet. The front side and the back side may have the same length. Alternatively, the front side may have a greater length than the back side, or the back side may have a greater length than the front side.

In one example, the stopper may have a front side 672 configured to slide over an outer face of the bracelet. The stopper may have a rear side 674 configured to slide over an inner face of the bracelet. The connecting portion 676 may connect the front side and the back side of the stopper. The connecting portion may have a curved shape and/or may apply sufficient strength to keep the stopper in place on the bracelet. Sufficient force may be exerted by the front and back sides of the stopper to provide a pinching effect, to keep the stopper on the bracelet. In some instances, the front side may have a flat shape while the back side may have a curved shape. The curved shape may aid in applying pressure to the surface the bracelet and keeping the stopper on the bracelet. The front side may be flat for aesthetic reasons. In some embodiments, the front side may be longer than the back side. The front side may extend along the entire width or most of the width of the bracelet. In some instances, the stopper may be a clip or have a similar form factor.

As illustrated, the front faces of the keepsakes 640*a*, 640*b*, 640*c* may be displayed on a first surface of the bracelet. A stopper 670 may prevent motion of the keepsakes along the length of the bracelet. The stopper may be taken on or off the bracelet directly without having to open the bracelet. Stoppers may be positioned anywhere along the length of the bracelet. Single keepsakes or multiple keepsakes may be positioned between stoppers. Single stoppers or multiple stoppers may be positioned between keepsakes.

In some embodiments, a mesh bracelet may be a single wrap mesh bracelet as illustrated. In some instances, a mesh bracelet may have an extended length that may permit multi-wrapping. Any description herein of multi-wrapping may apply to any type of substrate described herein, which may include wristbands, mesh bracelets, bangles, belts, or other types of substrates mentioned herein.

Figure 7D:
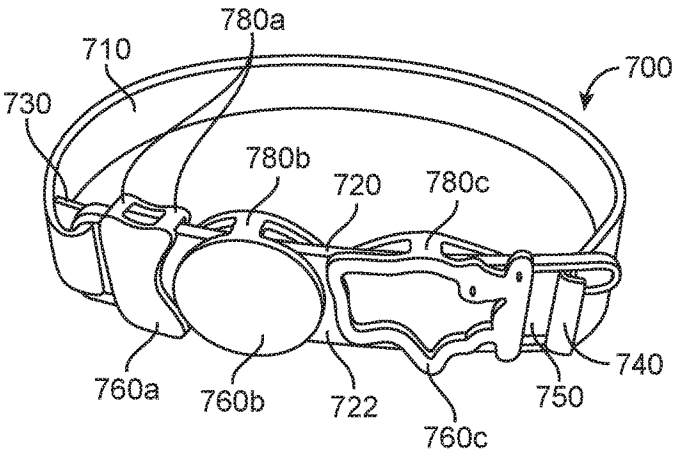
FIGS. 7A-7E show an example of a bangle and keepsakes on the bangle, in accordance with an embodiment of the invention.
Figure 7E:
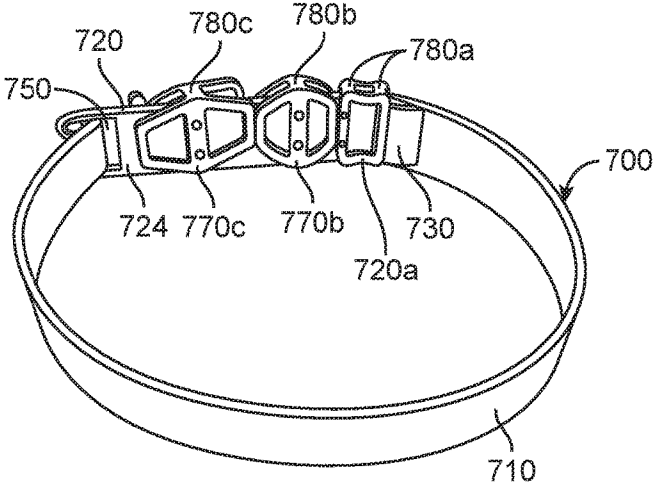
Figure 7A:
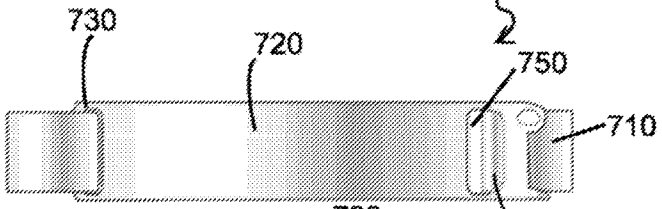

FIGS. 7A-7E show an example of a bangle and keepsakes on the bangle, in accordance with an embodiment of the invention. FIG. 7A shows a front view of a bangle 700. A bangle may be formed from a substantially rigid material. In some embodiments, the portions of the bangle may remain substantially rigid and may not flex substantially. In some instances, the portions of the bangle may not flex by more than 1, 2, 3, 5, 10, or 15 degrees. The bangle may be formed from a metal, such as metals described elsewhere herein, or from any other material described herein. The portions of the bangles may be formed from substantially solid materials. The surfaces of the bangle may be substantially smooth and uninterrupted.

The bangle 700 may have a first portion 710 and a second portion 720 that may be movable relative to the first portion. The first portion and second portions may be substantially rigid materials. The first portion and second portion may be formed from the same materials. The first portion may wrap around a majority of a wearer's wrist, arm, or ankle. The first portion may account for at least 30%, 40%, 50%, 60%, 65%, 70%, 75%, 80%, 85%, or 90% of the circumference of the bangle. The first portion may be a backing or support portion of the bangle. The second portion may wrap around a portion of the wearer's wrist, arm, or ankle. The second portion may account for less than about 70%, 60%, 50%, 40%, 35%, 30%, 25%, 20%, 15%, or 10% of the circumference of the bangle. Optionally, the first portion may have a greater length than the second portion. Alternatively, the second portion may have a greater length than the first portion. The second portion may be a decorative or displayed portion of the bangle. Keepsakes may be mounted onto the second portion. Keepsakes may or may not be mounted onto the first portion.

The second portion 720 may be movable relative to the first portion 710. A pivot point 730 may be provided that connects the second portion to the first portion. The second portion may pivot around the pivot point. The pivot point may be a hinge that permits the first and second portions to move relative to one another. The pivot point may include a curved region on the first portion, around which an end of the second portion may be applied. The end of the second portion may slide around the curved region of the first portion, which may permit the second portion to move about a range of angles about the pivot point. The curved region of the first portion may be welded or soldered so that the second portion cannot escape. Alternatively, no welding or soldering is provided.

A closure may be provided for the bangle 700. The closer may permit the second portion to move between a closed and opened position. When in a closed position, the second portion may remain fixed relative to the first portion. The closure may include features such as a hook 740 on the first portion that may pass through an opening 750 of the second portion. The hook may overlie an outer surface of the second portion to keep the bangle closed. A user may squeeze the first portion of the bangle to cause the hook to move backwards and permit the hook to pass through the opening, thereby permitting the bangle to open.

Figure 7B:
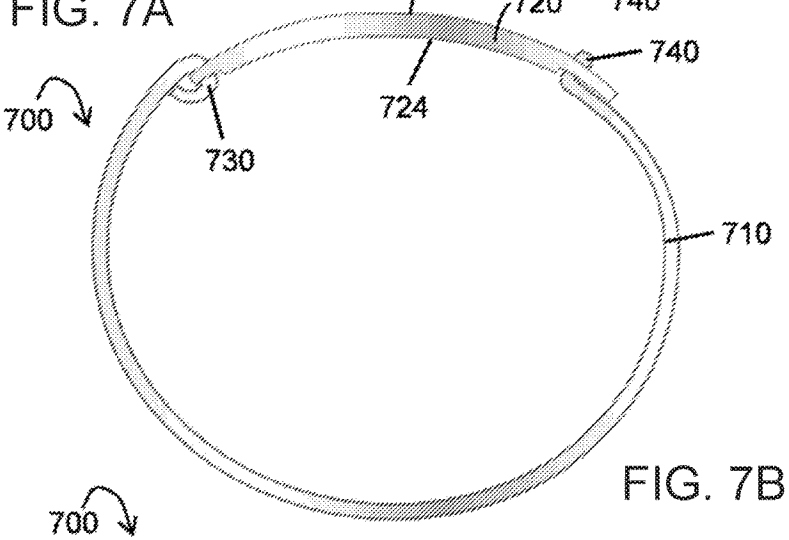

FIG. 7B shows a bottom view of the bangle. As previously discussed, a second portion 720 may be pivotally attached to first portion 710. The second portion may have an outer surface 722 and an inner surface 724. A pivot point 730 may be provided about which the second portion may pivot between an open position and a closed position. The pivot point may optionally be provided by a curved region of the first portion of the bangle. The first portion of the bangle may also include a hook 740 that may pass through an opening of the second portion. In alternative embodiments, the second portion may have a hook that may pass through an opening of the first portion. Other closure mechanisms may be used, which may include fasteners, clasps, buckles, clamps, sliding and locking members, hook and loop fasteners, or other types of techniques. The bangle may have a substantially circular, elliptical, or oval cross-sectional shape when viewed from the top or bottom. The bangle may be formed from a rigid material that may maintain the substantially circular, elliptical, or oval cross-sectional shape.

Figure 7C:
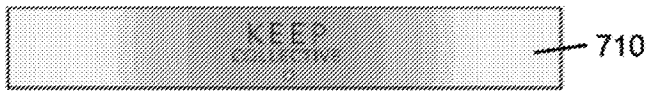

FIG. 7C shows a rear view of the bangle. The rear of the bangle may optionally have room from branding or a logo. The rear of the bangle may have a logo or other forms of branding provided on an outer surface and/or an inner surface. Alternatively, branding or a logo may appear on any other portion of the bangle. For instance, as shown in FIG. 7A, a shape of an end of the bangle near the opening may be provided for branding purposes. For example, if the logo is a key, the end of the bangle may have a key shape.

FIG. 7D shows an example of a bangle with keepsakes thereon. Keepsakes may slide onto a portion of a bangle. In some instances, the keepsakes may slide onto a second portion 720 of the bangle. The second portion of a bangle may have a flat, open end through which the keepsakes may slide on. In some instances, the first portion of the bangle may be configured so that keepsakes may not slide on. For example, a hook 740 on an open end of the first portion of the bangle may prevent keepsakes from sliding on. Thus, keepsakes may only be provided on a second portion of the bangle without being provided on a first portion of a bangle. In other instances, keepsakes may slide onto the first portion of the bangle. In some instances, the keepsakes may slide onto the first portion despite the hook. In other instances, no hook is provided. On a bangle, keepsakes may be provided on a second portion without being able to slide onto a first portion, keepsakes may be provided on a first portion without being able to slide onto a second portion, or keepsakes may be provided on both the first and second portions.

Front faces of the keepsakes 760*a*, 760*b*, 760*c* may contact an outer surface 722 of the second portion 720 of the bangle. The keepsakes may slide onto the second portion of the bangle through an open end of the second portion of the bangle. The keepsakes may also have back sides, top sides 780*a*, 780*b*, 780*c* and/or bottom sides that may keep the keepsakes on the bangle. The keepsakes may slide along freely on the bangle. The keepsakes may run into the pivot point 730 and not slide past the pivot point. When the bangle is closed, the keepsakes may run into the hook 740 and not slide past the hook. In some instances, the keepsakes may slide freely between the pivot point and the hook. In other instances, one or more stoppers may be employed. The stoppers may prevent the keepsakes from sliding past the stoppers. The stoppers may have configurations or placements as described elsewhere herein. Any number of stoppers may be placed on a bangle.

The front faces of the keepsakes 760*a*, 760*b*, 760*c* may be spaced apart. The front faces of the keepsakes may or may not contact or overlap one another.

In some embodiments, the keepsakes may be designed and/or dimensioned so that they can be used on a plurality of different types of jewelry substrates, as described elsewhere herein. For example, the same keepsake may be worn on a wristband and a bangle. In some instances, the keepsakes, wristband, mesh bracelets, and/or bangle may be dimensioned so that the keepsakes may be frictionally fit onto the wristband while more freely moving on a bangle. Stoppers may not be needed to keep the keepsakes in place.

These configurations may advantageously permit greater flexibility in the user of the keepsakes. As previously described, a user may be able to customize a jewelry substrate for particular keepsakes. For example, a user may have a keepsake or set of keepsakes that the user wishes to wear with different jewelry substrates. For example, a user may wear a keepsake with a leather wristband for a more casual look, while swapping out the jewelry substrate to wear the keepsake with a bangle to provide a more dressed-up look. A user may slide a keepsake onto a first jewelry substrate. The user may wear the article of jewelry. When the user wishes to change jewelry substrates, the user may slide the keepsake off the first jewelry substrate. The user may then slide the keepsake onto a second jewelry substrate, and wear the second article of jewelry. The user may interchange the wristband (e.g., single wrap or multi-wrap wristband), mesh bracelet, and/or bangle with the same set of keepsakes.

FIG. 7E shows a view of the bangle with a rear view of the keepsakes thereon. The first face may be the outer face. The first face may be exposed when the individual is wearing the bangle. A second face may be an inner face. The inner face may contact the wearer's wrist. The inner face may not be substantially exposed when the individual is wearing the bracelet. A first portion 710 and a second portion 720 may be provided. The first portion may have an inner face and an outer face. The second portion may have an inner face 724 and an outer face 722.

The keepsakes may have rear sides 770*a*, 770*b*, 770*c*. The rear sides may extend along the entire width of the bangle. The rear sides may be connected to the front sides 760*a*, 760*b*, 760*c* via top sides 780*a*, 780*b*, 780*c* and/or bottom sides. In some instances, the rear sides may have greater lengths than the front sides. Optionally, the rear sides may have a length extending beyond a length of the front side. This may permit the rear sides to come into contact with one another as shown in FIG. 7E while maintaining spacing between the front sides as shown in FIG. 7D. The shape of the rear sides may be selected based on the shape of the front sides. The shape of the rear sides may or may not roughly track the shapes of the respective front sides.

Optionally, stoppers may be used to keep the keepsakes at a desired location range along the length of the bangle. The desired location range may be the space between two stoppers. In some embodiments, a stopper may be provided on a second portion near the open end to prevent keepsakes from inadvertently falling off an open end of the second portion when the bangle is opened. A front side of the stopper may contact an outer face of the bangle. A back side of the stopper may contact an inner face of the bangle. The stopper may have a top surface or bottom surface. The stopper may or may not have both a top surface and a bottom surface.

Figure 7F:
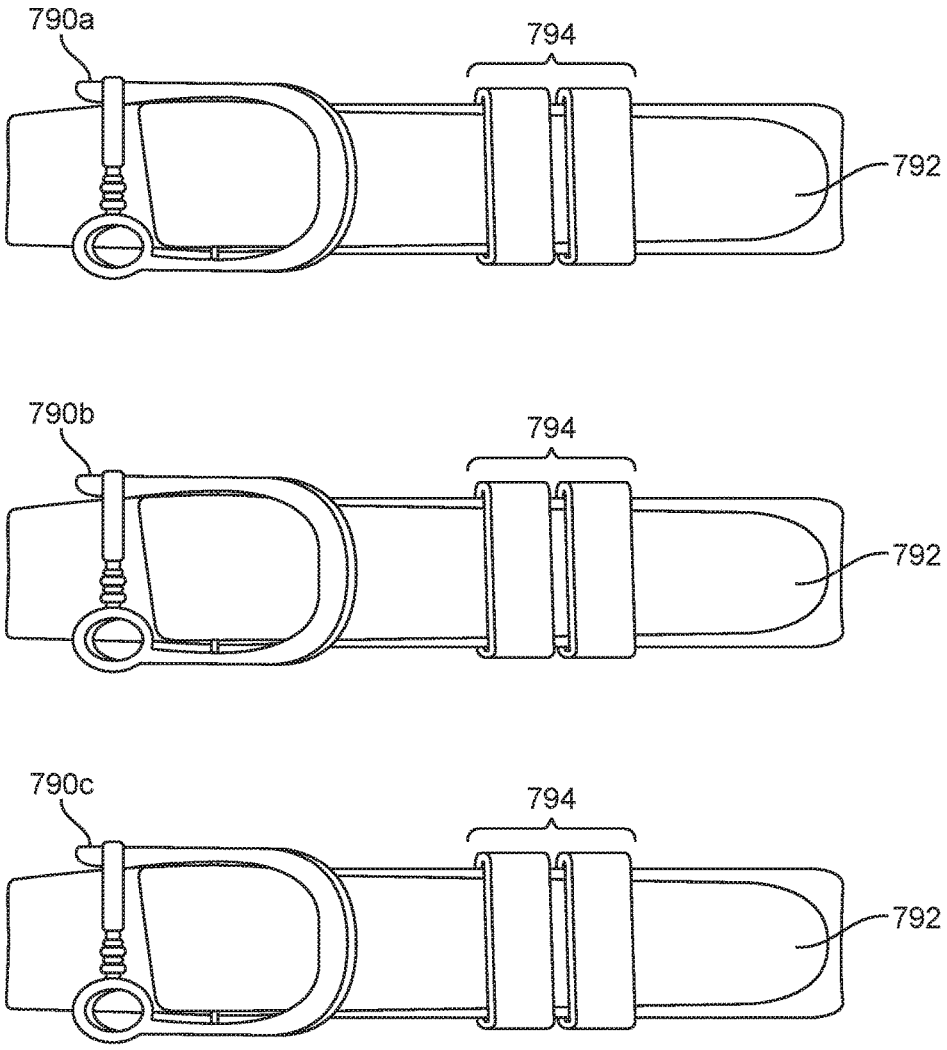
FIG. 7F shows an additional example of a wristband that will support one or more keepsakes.

FIG. 7F shows an additional example of a wristband that will support one or more keepsakes. The wristband may have any form factor of any other type of jewelry or accessory that goes around the wrist as described elsewhere herein. The wristband may have any form factor of any jewelry or accessory described elsewhere herein. The wristband may form as a substrate upon which keepsakes may slide and be supported. The keepsakes may have any of the characteristics as described elsewhere herein.

The wristband may be made from any material that may be used to form a substrate for the one or more keepsakes. The wristband may be made from a flexible or bendable material. In some instances, the material may be a silicone or any other type of polymer. The material may be resistant to fading in the sun, heat damage, or water damage. The material may be rubber or have rubber-like properties. The material may have low thermal conductivity, have low chemical reactivity, have low or no toxicity, have high thermal stability, be water repellent or form watertight seals, may not support microbiological growth, have low oxygen reactivity, have low electrical conductivity, and may or may not have high gas permeability. The material may have a high coefficient of friction (e.g., greater than about 0.15, 0.2, 0.25, 0.3, 0.4, 0.5, 0.6, 0.7, 0.75, or 0.8), which may aid with keeping the keepsakes in position on the material. The material or properties of the material used to form the wristband may be applied to any other type of jewelry or accessory described elsewhere herein.

The wristband (or any other jewelry or type of accessory) may have a buckle 790*a*, 790*b*, 790*c* that may permit an end 792 of the wristband to pass through. One or more additional straps 794 may hold the end of the wristband to the wristband after the end has slid through the buckle. The wristband may or may not include holes through which a protrusion or tongue of the buckle may slide through. The buckle may or may not be formed from a different material as the rest of the wristband. For instance, the buckle may be formed from metal while the rest of the wristband includes silicone. The straps may or may not be formed from the same material as the rest of the wristband. For instance, the straps and the rest of the wristband may be formed from silicone. The wristband may or may not be formed from a different material as the keepsakes. For instance, the keepsakes may be formed from metal while the rest of the wristband includes silicone.

Figure 11:
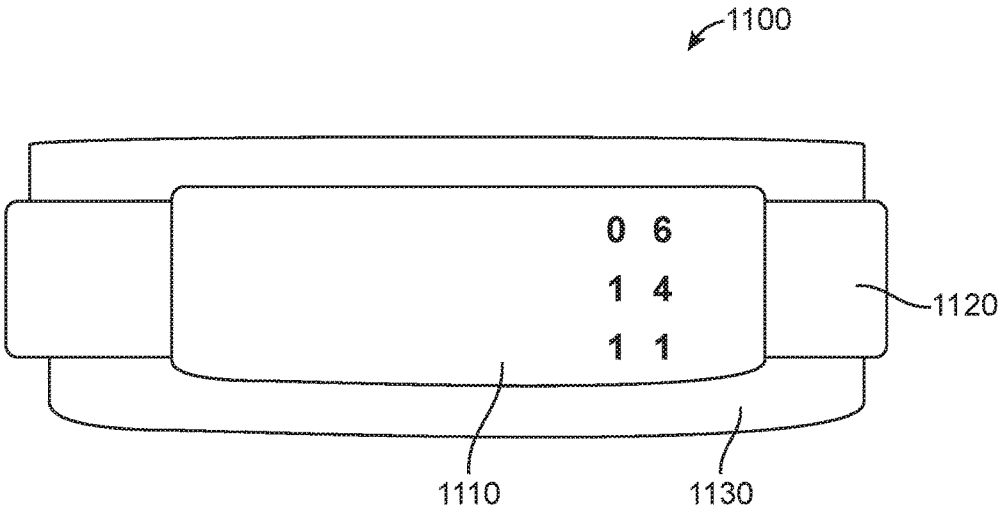
FIG. 11 shows an additional example of wrist accessory that may receive one or more keepsakes.

FIG. 11 shows an additional example of wrist accessory that may receive one or more keepsakes. The wrist accessory 1100 may be a men's wrist accessory, or a unisex wrist accessory. The wrist accessory may include a keepsake portion 1120 that may be capable of receiving one or more keepsakes 1110. The wrist accessory may include an additional portion 1130 that is not configured to receive a keepsake. In some instances, the keepsake portion may overlay the additional portion of the wristband. The keepsake portion may encircle the additional portion of the wrist accessory. The keepsake portion may lie flush against the additional portion of the wrist accessory. In some instances, multiple keepsake portions may be provided on a wrist accessory, or any other accessory described elsewhere herein. The multiple keepsake portions may be configured to accept the same types of keepsakes, or same dimensions of keepsakes. Alternatively, the multiple keepsake portions may be configured to accept different types of keepsakes or different dimensions of keepsakes. For instance, a first keepsake portion may accept a first keepsake of a particular dimension while not accepting a second keepsake of a different dimension. The second keepsake portion may accept the second keepsake while not accepting the first keepsake.

Figure 8D:
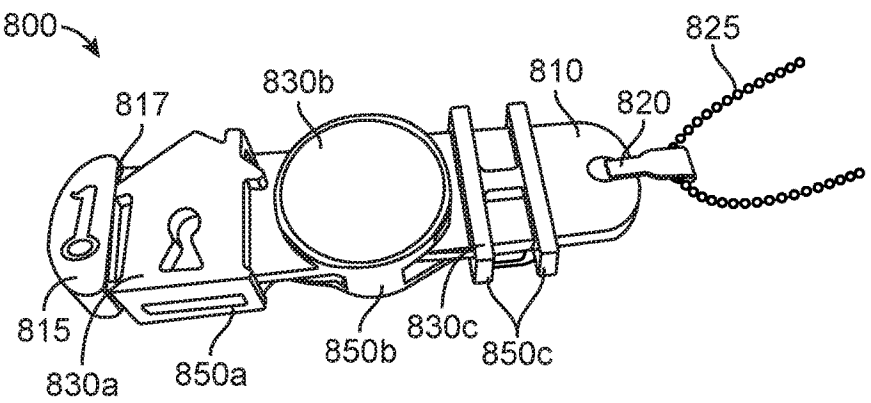
FIGS. 8A-8E show an example of a pendant and keepsakes on the pendant, in accordance with an embodiment of the invention.
Figure 8E:
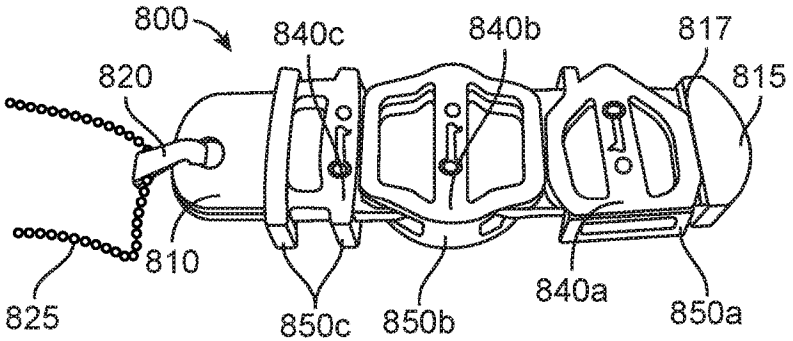
Figure 8B:
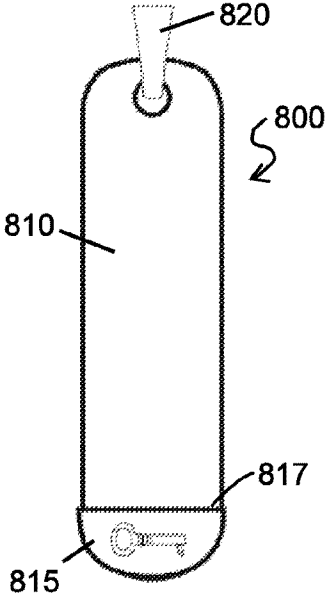
Figure 8C:
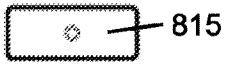
Figure 8A:
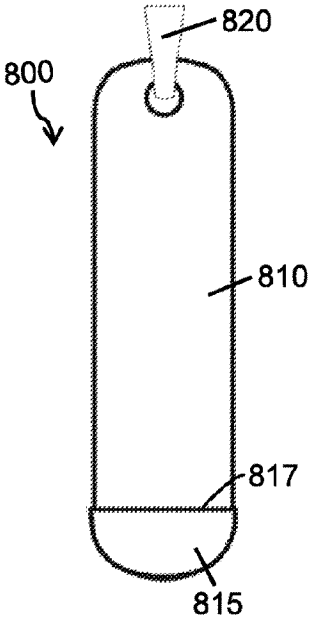

FIGS. 8A-8E show an example of a pendant and keepsakes on the pendant, in accordance with an embodiment of the invention. FIG. 8A shows a rear view of the pendant. FIG. 8B shows a front view of the pendant. FIG. 8C shows a bottom view of the pendant. The pendant 800 may be worn on a neck of a wearer. The pendant may dangle from a chain 825, set of links, braid, strands, mesh, band, wire, cord, or any other type of structure from which the pendant may hang. The chain may go around a wearer's neck. The pendant may be a jewelry substrate. The pendant may be an elongate member.

The pendant may include a body 810 and a base 815. The body of a pendant may be substantially flat. A front face and rear face of the pendant may be substantially planar and parallel to one another. The thickness of the pendant may be less than the width of the pendant. The thickness of the pendant may be less than 50%, 40%, 30%, 20%, 10%, 5%, or 1% of the width of the pendant. In some instances, a front side of the pendant body and the rear side of the pendant body may look substantially identical. They may have the same characteristics. The pendant body may be formed as a single integral piece. The pendant body may be formed as a single solid piece. The pendant body may be formed from a rigid or semi-rigid material. The pendant body may be formed from a metal, such as any of the metals described elsewhere herein. The pendant body may be formed from any other type of material described elsewhere herein.

The base 815 of the pendant may be substantially flat. The base of the pendant may have a greater thickness than the body 810 of the pendant. The extra thickness from the base may form a shelf 817 upon which keepsakes may rest. The shelf may extend on the front side of the pendant and/or the back side of the pendant. In some instances, the shelf may extend on both the front and back sides of the pendant. The base may prevent keepsakes from sliding past the base. The base may be integrally formed with the body of the pendant. The base and body may be formed from a single piece. In other instances, the base may be formed from a different piece and attached to the body. In some instances, branding or a logo may be displayed on the base. For instance, branding or a logo may be displayed on a front face of the base (e.g., FIG. 8B) and/or a bottom surface of the base (e.g., FIG. 8C). The base may have the same width as the body, or may have a greater width than the body. When the base has a greater width than the body, the shelf may circumscribe the pendant where the body meets the base.

The pendant 800 may include a loop 820 through which a chain or other member may pass through. The loop may be attached through a hole in the body 810. The loop may move relative to the body. Alternatively, the loop may be integrally formed into the pendant body. The pendant may have a 'dogtag' shape.

FIG. 8D shows an example of a pendant 800 with keepsakes mounted thereon. FIG. 8E shows an example of a rear view of a pendant with keepsakes mounted thereon. One, two, three, four, five, six or more keepsakes may be mounted onto a pendant. The keepsakes may slide onto a pendant body 810. In some instances, the keepsakes may slide onto the pendant body from an end opposing the base 815. The base may or may not be removable from the body. In some instances, the base is integrally formed with the body. The keepsakes may slide over the loop 820 to slide onto the pendant body. When the pendant is hanging with the chain 825 and worn around a wearer's neck, the chain may prevent the keepsakes from sliding off. In some instances, the loop may be dimensioned so that the keepsakes may slide on with sufficient force from a wearer, but do not easily slide off without extra force being applied by the wearer.

A front side 830*a*, 830*b*, 830*c* of the keepsake may contact a front face of the pendant body 810. A rear side 840*a*, 840*b*, 840*c* of the keepsake may contact a rear face of the pendant body. The front side and the rear side of the keepsake may be connected to one another via one or more top sides and/or bottom sides 850*a*, 850*b*, 840*c*. The keepsakes may slide onto the pendant body and completely encircle the pendant body. When a cross-section of the pendant body is taken, the pendant body may be entirely surrounded by the keepsake. The keepsakes may be stopped by a base 815 from sliding further. When a pendant is hanging, the keepsakes may be propped upwards by the base. When a plurality of keepsakes are provided on a pendant, the lowest keepsake may contact and be supported by the base. The next lowest keepsake may be supported by the lowest keepsake. Each keepsake may be supported by the keepsake beneath it, when the pendant is hanging.

The keepsakes may be configured so that the front sides 830*a*, 830*b*, 830*c* remain spaced apart when the keepsakes are adjacent to one another on the pendant body 810. The rear sides 840*a*, 840*b*, 840*c* may contact one another on the pendant body. When the pendant is hanging, the pendant may have a vertical orientation. Keepsakes may be stacked on the vertical pendant. In some instances, when the keepsakes are stacked, they may be positioned so that the rear sides of the keepsakes contact one another. In some instances, when the rear sides of the keepsakes contact one another, the front sides may be remain spaced apart. When the keepsakes are stacked, the front sides may optionally not contact one another. In other embodiments, the front sides may contact one another.

In some instances, the keepsakes may move freely along the pendant body. Optionally, stoppers, such as those described elsewhere herein, may be provided. The stopper may prevent keepsakes from sliding along the pendant body beyond the stopper. Stoppers may or may not be used with the pendants.

The pendant body is provided by way of example only and are not limiting. For instance, a dog-tag type configuration may be provided as illustrated. The elongated portion may have a substantially vertical orientation when worn around the wearer's neck. In other embodiments, the pendant may be arranged so that the elongated body has a substantially horizontal position when worn around the wearer's neck. The horizontal pendant may be supported on both ends sides by a chain or other device. The keepsakes may slide on and be arranged horizontally in a row on the horizontal pendant. In other instances, the pendant body may have an arced shape onto which the keepsakes may slide. Optionally, the arc may be provided so that the front and back portions of the pendant form a 'C' shape. The 'C' shape may lie substantially flat against the wearer's torso. The ends of the arc may be supported on both ends by chain. Alternatively, a single end of the arc may be supported by the chain. The keepsakes may be mounted so that their front face is exposed along the curved pendant.

Optionally, pendants may be reversible. In some instances, each side of a pendant may have the same characteristics. Alternatively, different characteristics may be provided on different sides of the pendant. For example, a first side may be plated with a first type of metal while a second side may be plated with a second type of metal. Optionally, the second type of metal may have different visual characteristics (e.g., color, finish, shine), than the first type of metal. The keepsakes may be arranged so that the front sides of the keepsakes are over a first side of the pendant. The pendant may be reversed by switching the orientation of the keepsakes so that the front sides of the keepsakes are over a second side of the pendant. The pendant may be worn so that the front sides of the keepsakes are exposed. The rear side of the pendant may be covered and/or face the wearer's torso.

Figure 8F:
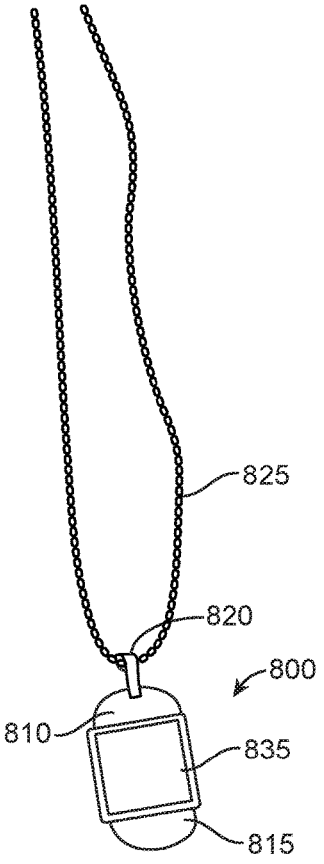
FIG. 8F shows an additional example of a pendant with a keepsake on the pendant.

FIG. 8F shows an additional example of a pendant, with a keepsake on the pendant 800. As previously described, the pendant may have a pendant body 810 and a pendant base 815. The pendant may be supported by a necklace portion 825 that is configured to go around a wearer's neck. In some embodiments, the necklace portion may be a cord. Alternatively, the necklace may be a chain, mesh, strands, multiple chains, leather, wire, or any other configuration as described elsewhere herein. The pendant may be supported from the necklace portion by a loop 820. As previously described, in some embodiments, the pendant may have a dog-tag configuration and may dangle from the necklace at a single point. In alternative embodiments, as described elsewhere herein, the pendant may be supported by the necklace at multiple points.

A keepsake 835 may be supported by the pendant 800. The keepsake may slide over a body 810 of the pendant. The keepsake may rest on the pendant base 815 or may not slide past the pendant base. In some instances, a single keepsake may be on the pendant. Alternatively, multiple keepsakes may be on the pendant. The pendant body may be sized or proportioned to accept any number of keepsakes. In some embodiments, a single keepsake may be sized or shaped to cover a majority of the pendant body (e.g., greater than 50%, 60%, 70%, 80%, 90%, or 95% of the pendant body). Alternatively, a single keepsake may be sized or shaped to cover less than the majority of the pendant body (e.g., less than 5%, 10%, 20%, 30%, 40%, or 50% of the pendant body).

Figure 8G:
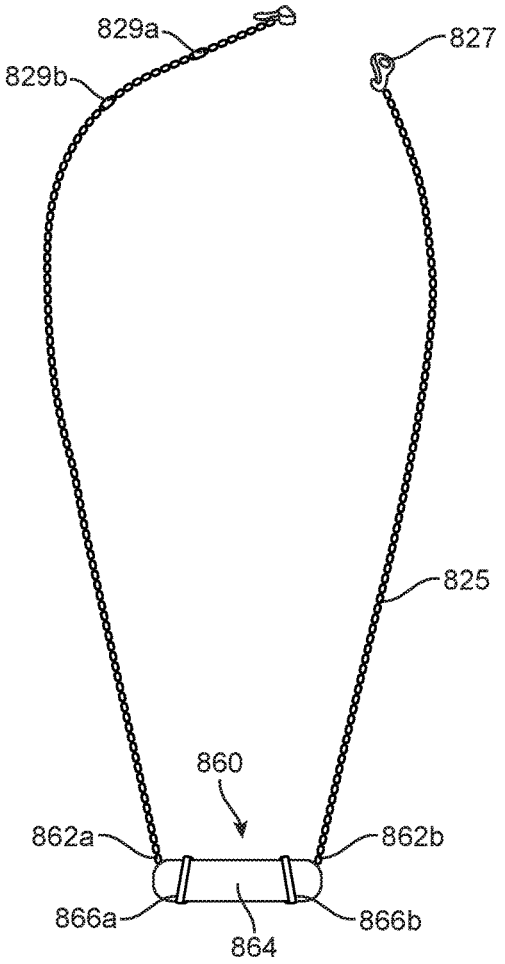
FIG. 8G shows an additional example of a pendant configuration.

FIG. 8G shows an additional example of a pendant configuration. As previously described, a pendant may be a primarily vertically oriented pendant that may hang from a single point (as illustrated in FIG. 8F). Alternatively, the pendant 860 may be a primarily horizontally oriented pendant that may hang from multiple points 862*a*, 862*b*. In various embodiments, the pendant body may have any shape which may provide a primarily horizontal or vertical position while being supported from any number of points (e.g., one, two, three, four, or more points). In some instances, the orientation of the pendant may refer to a direction in which keepsakes may slide on or off. For instance, in a vertically oriented pendant, the keepsakes may slide on or off in a vertical direction. In a horizontally oriented pendant, the keepsakes may slide on or off in a horizontal direction. The orientation of the pendant may correspond to a direction of motion of the keepsake when sliding on or off.

The points 862*a*, 862*b* of connection of the pendant with a necklace portion 825 may have any configuration. For example, one or more separate loop may be provided. In some instances, features such as loops, may be built into the pendant, and may connect with one or more corresponding loops or clasps of the necklace portion. The pendant may be configured to be easily removable from the necklace portion (e.g., with clasps), or may be configured to be built into the necklace portion. The connection points may or not be at or near the end of pendant. For instance, a connection point may be within 25%, 20%, 15%, 10%, 5%, 3%, or 1% of an end of the pendant along a length of the pendant. Multiple connection points may be provided at or near the opposing ends of the pendant.

The pendant may have a pendant body 864. The pendant may or may not include one or more built-in stopping features 866*a*, 866*b*. The built-in stopping features may or may not completely prevent the keepsakes from sliding past the built-in stopping features. In one example, the built-in stopping feature may function as a pendant base which may prevent the keepsake from sliding past the built-in stopping feature. In some instances, the built-in stopping feature may decrease the likelihood of the keepsakes sliding past, although they may not stop them completely. In some embodiments, multiple built-in stopping features may be provided. The portion of the pendant body between the built-in stopping features may be configured to accept one or more keepsakes. The keepsakes may be kept between the built-in stopping features while the pendant is worn. Alternatively, no built-in stopping features may be provided.

A keepsake may be configured to slide over an end of the pendant body. The keepsake may or may not traverse a built-in stopping feature to reach a central portion of the pendant body. The keepsake may slide over a portion of the necklace portion (e.g., over a chain, or any other material or configuration), and subsequently onto the pendant body.

A necklace portion 825 may support the pendant body at the two or more points 862*a*, 862*b*. The necklace portion may be made from any material or may have any configuration as described elsewhere herein. The necklace portion may have a clasp 827 that may be used to connect or disconnect ends of the necklace portion. The necklace portion may have a fixed length or may have an adjustable length. An adjustable length may advantageously permit a wearer to adjust the height of the pendant. This may be useful in accommodating different necklines of apparel or to provide different looks. In some instances, an adjustable length may be implemented using one or more loops 829*a*, 829*b* that may be configured to interact with a clasp. The clasp may lock in with a loop at the end or closer to an end of the necklace to provide a longer necklace (e.g., allow the pendant to hang lower when worn), or may lock in with a loop further from an end of the necklace to provide a shorter necklace (e.g., allow the pendant to ride higher when worn).

Figure 8I:
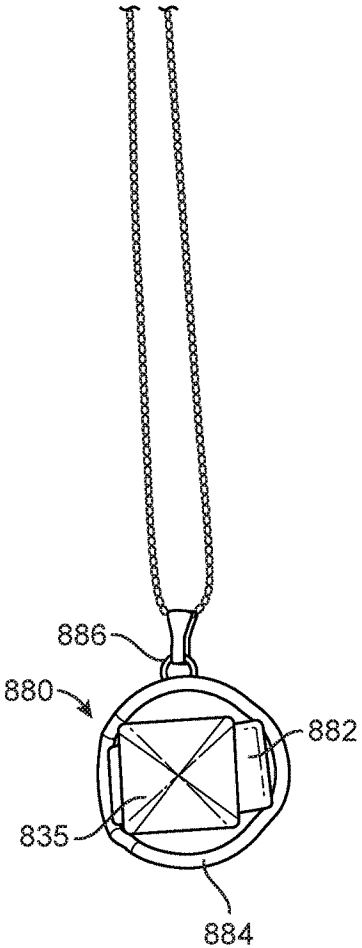
FIG. 8I shows an example of a gated pendant with a keepsake.
Figure 8H:
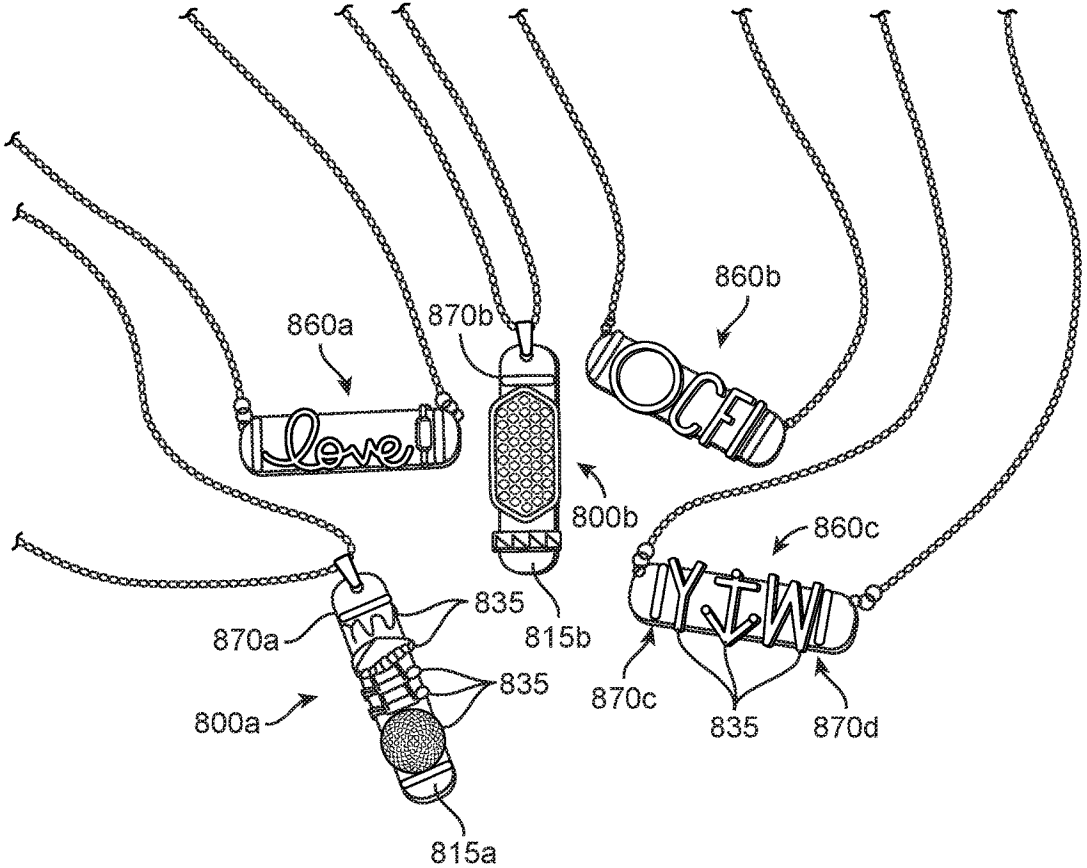
FIG. 8H shows various examples of pendants with keepsakes.

FIG. 8H shows various examples of pendants with keepsakes. The pendants may be substantially vertically oriented pendants 800*a*, 800*b* or may be substantially horizontally oriented pendants 860*a*, 860*b*, 860*c*.

Vertically oriented pendants 800*a*, 800*b* may be supported from a necklace portion at one connection point. Alternatively, the vertically oriented pendants may have multiple connection points to the necklace portion. The vertically oriented pendants may be configured to receive one or more keepsakes 835 on a pendant body so that the keepsakes may slide on or off in a vertical direction. The pendants may optionally include a base 815*a*, 815*b* which may prevent the keepsakes from sliding off the pendant body. The base may support the weight of the keepsakes when the pendant is vertically oriented. Optionally, a stopper 870*a*, 870*b* may be provided. The stopper may have any characteristic of a stopper as described elsewhere herein. The stopper may prevent the keepsake 835 from sliding past the stopper. The stopper may clip on from the side. The stopper may or may not completely encircle the pendant body. The stopper may be sized and shaped to appear to be a part of the pendant body. For example, a length of the stopper may be close to the width of the pendant body.

In some embodiments, a stopper may be placed at or near the top of a vertically oriented pendant after the desired keepsake(s) have been slid onto the pendant body. The stopper may or may not contact the keepsake on the pendant body. In some instances, a gap may be provided between the keepsake and the stopper. Optionally, a single stopper may be provided on a vertically oriented pendant, above the keepsakes. In alternative embodiments, multiple stoppers may be provided on a vertically oriented pendant. In some instances, stoppers may be provided above and below a set of keepsakes. One or more keepsakes may or may not be separated by one or more stoppers. In some instances, a pendant base may not be required and a stopper may be used instead.

Horizontally oriented pendants 860*a*, 860*b*, 860*c* may be supported from a necklace portion at multiple connection point. Alternatively, the horizontally oriented pendants may have a single connection point to the necklace portion. The horizontally oriented pendants may be configured to receive one or more keepsakes 835 on a pendant body so that the keepsakes may slide on or off in a horizontal direction. The pendants may or may not include a built-in stopper which may prevent the keepsakes from sliding off the pendant body, or may reduce the likelihood the keepsakes will slide off the pendant body. Optionally, one or more stoppers 870*c*, 870*d* may be provided. The stopper may have any characteristic of a stopper as described elsewhere herein. The stopper may prevent the keepsake 835 from sliding past the stopper. The stopper may clip on from the side. The stopper may or may not completely encircle the pendant body. The stopper may be sized and shaped to appear to be a part of the pendant body. For example, a length of the stopper may be close to the width of the pendant body.

In some embodiments, two stoppers may be placed at or near the ends of a horizontally oriented pendant. In some instances, one or more of the stoppers may be placed on after the desired keepsake(s) have been slid onto the pendant body. In one example, one of the stoppers may be placed on the pendant body, one or more keepsakes may slide onto the body, and then a second stopper may be provided on the other side of the one or more keepsakes. One or more keepsakes may or may not be separated by one or more stoppers. The stopper may or may not contact the keepsake on the pendant body. In some instances, a gap may be provided between the keepsake and the stopper. In some instances, stoppers may be provided to the right and to the left of a set of keepsakes. In some instances, a built-in stopper may be used in the place of one or more external stoppers.

FIG. 8I shows an example of a gated pendant with a keepsake. The pendants may have any size or shape. The pendants may have a substantially elongated shape and/or may have substantially round, square, triangular, pentagonal, hexagonal, octagonal, crescent, or other shapes. The pendant may be substantially flat or may have a curved or bent surface. In some embodiments, an entirety of the pendant body may form a substrate that may accept one or more keepsakes. In other instances, a portion of the pendant body may form a substrate that may accept one or more keepsakes. One or more additional portions of the pendant body may optionally not accept one or more keepsakes.

A gated pendant 880 is an example of a pendant that may have one or more keepsakes 835 mounted therein. The gated pendant may include a keepsake-receiving portion 882 that may serve a substrate that may accept one or more keepsakes. The gated pendant may optionally include a free portion 884 that is not configured to accept one or more keepsakes. The gated pendant may be attached to a necklace portion at one or more connection points 886. The necklace portion may have any characteristic, as described elsewhere herein. The connection point(s) may have any characteristic as described elsewhere herein.

The keepsake portion 882 of the gated pendant may include an open end through which the keepsake may slide onto the keepsake portion. The open end may remain open or may be movable between an open position and a closed position. The keepsake portion may optionally be attached to the rest of the gated pendant via a hinge or other mechanism that may permit the keepsake portion to pivot. The keepsake portion may pivot between an open position which may permit a keepsake to slide on or off, and a closed position, which may prevent a keepsake from sliding on or off. In another example, a separate hinge or pivot is not needed. The keepsake portion may be formed from a flexible material or structure that may permit the keepsake portion to bend to an open position and/or bend to a closed position. In some instances, mechanical features, such as clasps, hooks, snap-fits, buttons, hook and loop fasteners may be provided to keep the keepsake portion in a closed position when desired. In some instances, magnets may be employed to keep the keepsake portion in a closed position when desired.

One or more keepsakes 835 may be provided on the keepsake portion 882. In some instances, a single large keepsake may be provided which may cover a majority of the keepsake portion. In various embodiments, a single small keepsake may be provided, multiple small keepsakes may be provided, multiple large keepsakes may be provided or any combination of large and small keepsakes may be provided. The keepsakes may have any characteristic as described elsewhere herein.

A non-keepsake portion 884 may have any shape or configuration. In some instances, the non-keepsake portion may have a thickness that is too great to permit a keepsake from sliding on. The non-keepsake portion may form a support that may connect to the keepsake portion and/or bear the weight of the keepsake portion.

Figure 8J:
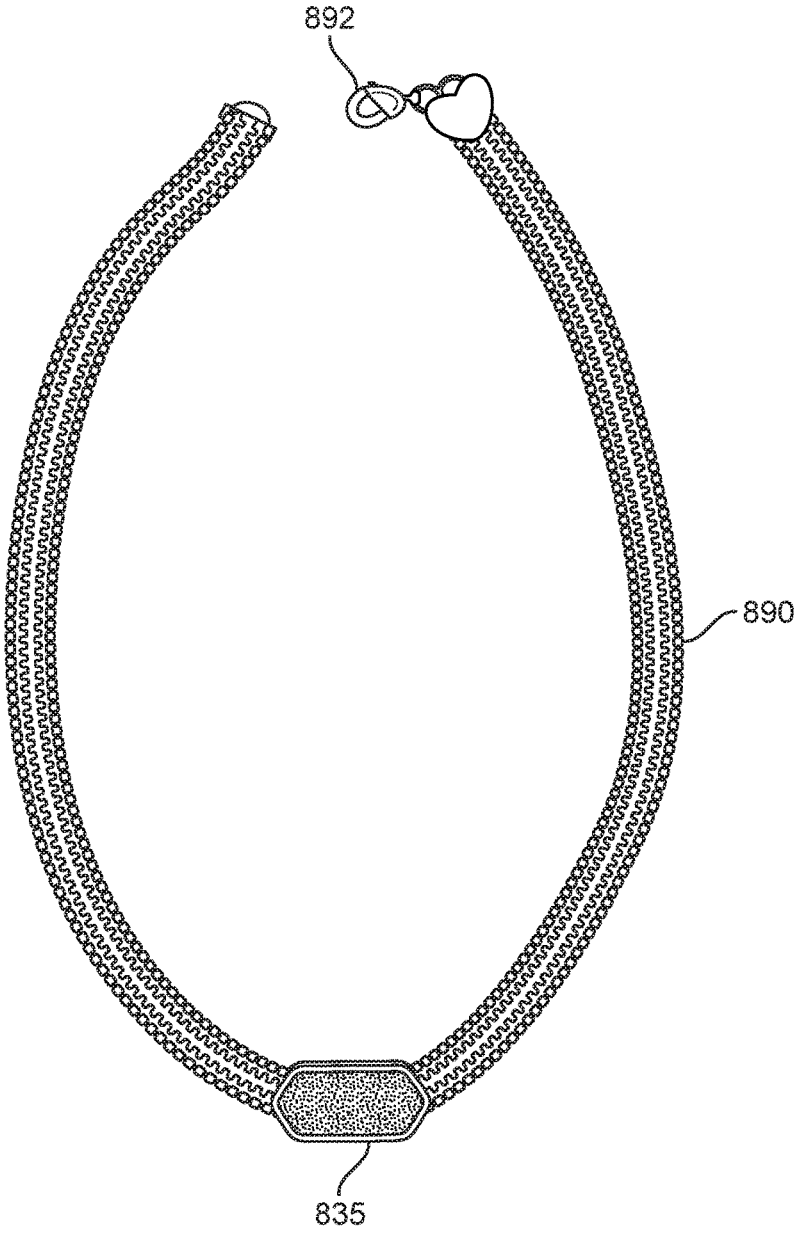
FIG. 8J shows an example of a necklace with a keepsake.

FIG. 8J shows an example of a necklace 890 with a keepsake 835. The necklace may have any length. For instance, the necklace may be a choker length (e.g., 35 cm to 41 cm). Alternatively, the necklace may be a princess length necklace (e.g., 45 cm to 50 cm), matinee length necklace (e.g., 56 cm to 58 cm), opera length necklace (e.g., 75 cm to 90 cm), or rope length necklace (e.g., greater than 90 cm). The necklace may optionally be a lariat necklace. The necklace may have a fixed length or may have an adjustable length. The necklace may have a closure mechanism 892, such as a clasp.

The necklace 890 itself may serve as a substrate for one or more keepsakes 835. The keepsakes may slide along the length of the necklace. The necklace may have a width that is greater than or equal to the thickness of the necklace. The necklace may be formed as a flexible or inflexible band, mesh, multiple strands, braids, cords, chains, or any other configuration. For instance, the multiple strands may be multiple chains that may lie next to one another and form as a substrate for one or more keepsakes.

In some embodiments, a single keepsake 835 may form as a central focal point of the necklace. The keepsake may be swapped out for other keepsakes. In some embodiments, multiple keepsakes may be provided on the necklace. The keepsake(s) may remain in place due to a friction fit. Alternatively, one or more stoppers may be provided which may control the position of the keepsakes. In other instances, the keepsakes may slide freely along the necklace while worn.

In some embodiments, necklaces may have keepsakes directly on the necklace and may support one or more pendants that may or may not also support additional keepsakes.

In some embodiments, the keepsakes may be designed and/or dimensioned so that they can be used on a plurality of different types of accessory substrates, such as jewelry substrates, as described elsewhere herein. For example, the same keepsake may be worn on a wristband and a pendant. In some instances, the keepsakes, wristband, and pendants may be dimensioned so that the keepsakes may be frictionally fit onto the wristband while more freely moving on a pendant. Any of the jewelry pieces may have any dimension. For example, a width of a jewelry substrate may be less than or equal to about 3 mm, 5 mm, 6 mm, 7 mm, 8 mm, 9 mm, 1 cm, 1.1 cm, 1.2 cm, 1.3 cm, 1.5 cm, 1.7 cm, 2 cm, 2.5 cm or 3 cm. The width of the jewelry substrate may be greater than any of the dimensions described. The width of the jewelry substrate may fall into a range between any two dimension values described herein. Different types of jewelry substrates may have the same width or different widths. Different types of jewelry substrates may have widths within 10% of one another to permit the same keepsakes to be used with the different jewelry substrates. Such dimensions are provided by way of example only and are not limiting. Stoppers may or may not be needed to keep the keepsakes in place. Any of the types of jewelry described herein may or may not employ stoppers to keep keepsakes in place.

These configurations may advantageously permit greater flexibility in the user of the keepsakes. As previously described, a user may be able to customize an accessory substrate for particular keepsakes. For example, a user may have a keepsake or set of keepsakes that the user wishes to wear with different jewelry substrates. For example, a user may wear a keepsake with a wristband to decorate the user's wrist, while swapping out the accessory substrate to wear the keepsake with a pendant to decorate the user's neck. This may be useful to accommodate different types of outputs with different necklines or sleeves. A user may slide a keepsake onto a first jewelry substrate. The user may wear the article of jewelry. When the user wishes to change jewelry substrates, the user may slide the keepsake off the first jewelry substrate. The user may then slide the keepsake onto a second jewelry substrate, and wear the second article of jewelry. The user may interchange the wristband (e.g., single wrap or multi-wrap wristband), mesh bracelet, bangle, and/or pendant with the same set of keepsakes. Similarly, a user may slide a keepsake onto a first accessory substrate. The user may wear or handle the accessory, such as jewelry. When the user wishes to change accessory substrates, the user may slide the keepsake off the first accessory substrate and slide the keepsake onto a second accessory substrate. The user may wear or handle the second accessory. For instance, the user may interchange any of the accessories described herein, such as wristband, bangle, mesh bracelet, pendant, choker, earrings, anklet, belt, headband, shoes (e.g., sandals), gloves, glasses/sunglasses, pet-collars, keychains, or other type of jewelry or accessory. The accessories may be womens' accessories, mens' accessories, pet accessories, or may be unisex or multi-purpose. The accessories may be used for adornment or decoration. The accessories may be used for other purposes, such as providing information (e.g., medical bracelets or tags, identifying bracelets or tags), keeping track of time, containing items, improving vision, securing apparel or hair, providing protection (e.g., hand protection, foot protection), or any other purpose.

Sliding keepsakes need not be limited to bracelets, wristbands, or bangles. Sliding keepsakes need not be limited to jewelry that goes on a wearer's wrist or arms. Sliding keepsakes need not be limited to jewelry and may be applied to any type of accessory. Sliding keepsakes may be applied to jewelry that is worn around the wearer's neck. For example, the sliding keepsakes may be applied to a pendant. The pendant may be personalized with keepsakes that may slide on or off. In other examples, the sliding keepsakes may be applied to a choker. The choker may be formed from a similar material as the mesh bracelet, wristband, or bangles.

Sliding keepsakes may also be applied to jewelry that can be worn on a wearer's ankle or leg. For example, sliding keepsakes may be worn as an anklet or garter. The anklet or garter may be formed from a similar material as the mesh bracelet, wristband, or bangle. Sliding keepsakes may also be applied to jewelry/accessories that can be worn on a wearer's torso, such as around a wearer's waist. For example, sliding keepsakes may be worn on a belt. The belt may be formed from a similar material as the mesh bracelet, wristband, or bangle.

In another example, the sliding keepsakes may be applied to jewelry that can be worn on a wearer's ear. For example, sliding keepsakes may be applied to earrings. In some instances, the earrings may have a base or body similar to a pendant base or body. For example, an earring base may dangle vertically from a wearer's ear at a single point and one or more keepsakes may be supported on the earring base. In another example, an earring base may have a curved or looping surface. For example, the earring base may form a hoop or loop supported by a wearer's ear. The keepsakes may be supported by the curved or looping earring base. The hoop or loop may form a full circle, or almost form a full circle (e.g., greater than 50%, 60%, 70%, 80%, 90%, 95%, or 99% of the circumference of a full circle). The hoop or loop may be configured such that a plane intersecting the circumference of the hoop is substantially orthogonal relative to a wearer's ear, or substantially parallel relative to the wearer's ear. Thus, the hoop may have a front-to-back orientation relative to the ear, or a side-to-side orientation relative to the ear. In another example, the earring base may be similar to a pendant body that may be supported at multiple points. For example, the earring base may dangle from a wearer's ear with a horizontal orientation, or oblique orientation, and may optionally be supported at both ends (e.g., by chains, wires, lines, etc.). In some instances, supports at multiple points on the earring base may be supported at a single point on the wearer's ear or multiple points on the wearer's ear. The earring may have a single earring base or multiple earring bases. Multiple earring bases for a single earring may have the same orientation or configuration, or may have different orientations and/or configurations. The keepsakes may slide relative to the earring base, or may be kept in place with the aid of stoppers. The sliding keepsakes may be added and/or removed from the base while the wearer is not wearing the earring. The sliding keepsakes may or may not be added and/or removed from the earring base when the wearer is wearing the earring. The earring base may be substantially solid material. Alternatively, the earring base may be from a semi-rigid or flexible material.

In another example, the sliding keepsakes may be applied to jewelry or accessories that can be worn on a wearer's head. For example, sliding keepsakes may be applied to headbands or other hair accessories. The sliding keepsakes may slide over a length of the headband. The headband may form as a substrate to accept the sliding keepsakes. Similarly, the sliding keepsakes may slide over a substrate portion in a hair pin, hair tie, head scarf, or any other head-related accessory. This may include a substrate portion forms the head-related accessory or is fixedly attached to the head-related accessory. The substrate portion may be attached at one, two, or more points. The substrate portion may or may not move between an open position and a closed position. Such descriptions of substrate portions need not be limited to head-related accessories and may apply to any type of accessory. Sliding keepsakes may also decorate portions of glasses or sunglasses. For instance, the keepsakes may be provided on the side of glasses/sunglasses (e.g., the piece that may extend to the ear).

Sliding keepsakes may be used on pet collars or leashes. For instance, the sliding keepsakes may be provided on the pet collar surrounding the pet's neck, portion of the pet's torso, or leash portion extending from the pet.

Sliding keepsakes may be provided on keychains. The keychains may have a strap configuration, pendant body-type configuration, or any other type of configuration.

The sliding keepsakes may be provided on footwear. For instance, the sliding keepsakes may be provided on a strap of a sandal. The sliding keepsakes may be provided on a substrate that may be on a top surface of a shoe, rear of the shoe, or side of the shoe. For instance, the substrate may be provided on any type of shoe (e.g., sneaker, pump, platform, sandal, slipper, loafer, flats, or any other type of shoe). The substrate may be capable of moving between an open and closed position with respect to the rest of the shoe, similarly to the gated pendant. Locking mechanisms may or may not be provided to keep the substrate in a closed position when desired.

The sliding keepsakes may be provided on gloves. For instance, the gloves may include a substrate on any portion of the gloves that may accept sliding keepsakes. The substrate may or may not move with respect to the rest of the gloves.

Figure 14:
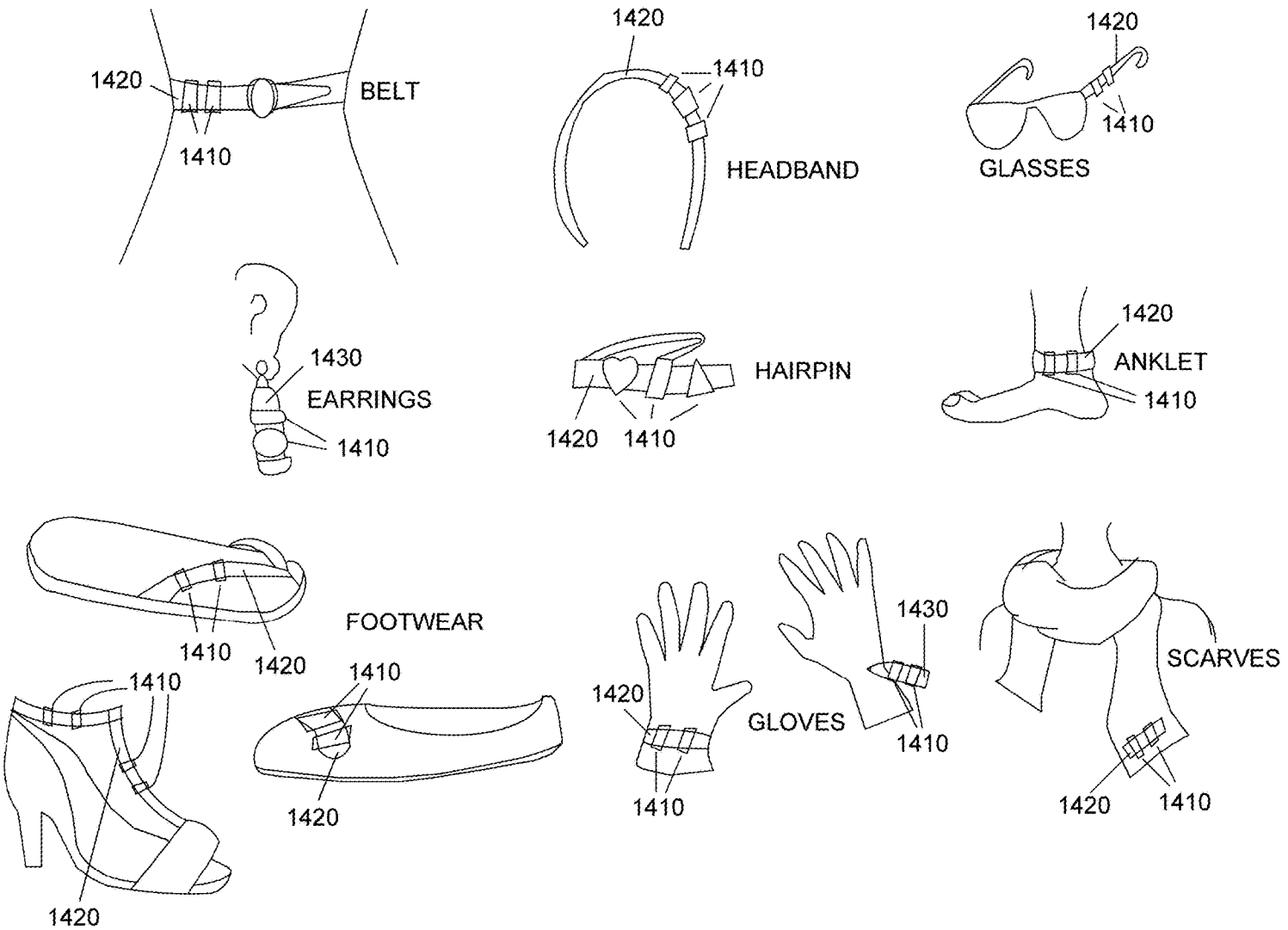
FIG. 14 provides several possible examples of how keepsakes may be applied to various accessories.

Several possible examples of how keepsakes may be applied to various accessories are provided in FIG. 14. The keepsakes 1410 may be attached to a substrate 1420 which may form a portion of the article itself. The substrate may be substantially secured to the article. In some instances the substrate may be secured to the article at multiple points. In some instances, the keepsakes may be attached to a dangling substrate 1430 which may be similar to a single-connection pendant configuration. Some examples of accessories illustrated may include belts, headbands, hair pins, glasses/sunglasses, earrings, anklets, various types of footwear, gloves, and scarves.

Figure 12:
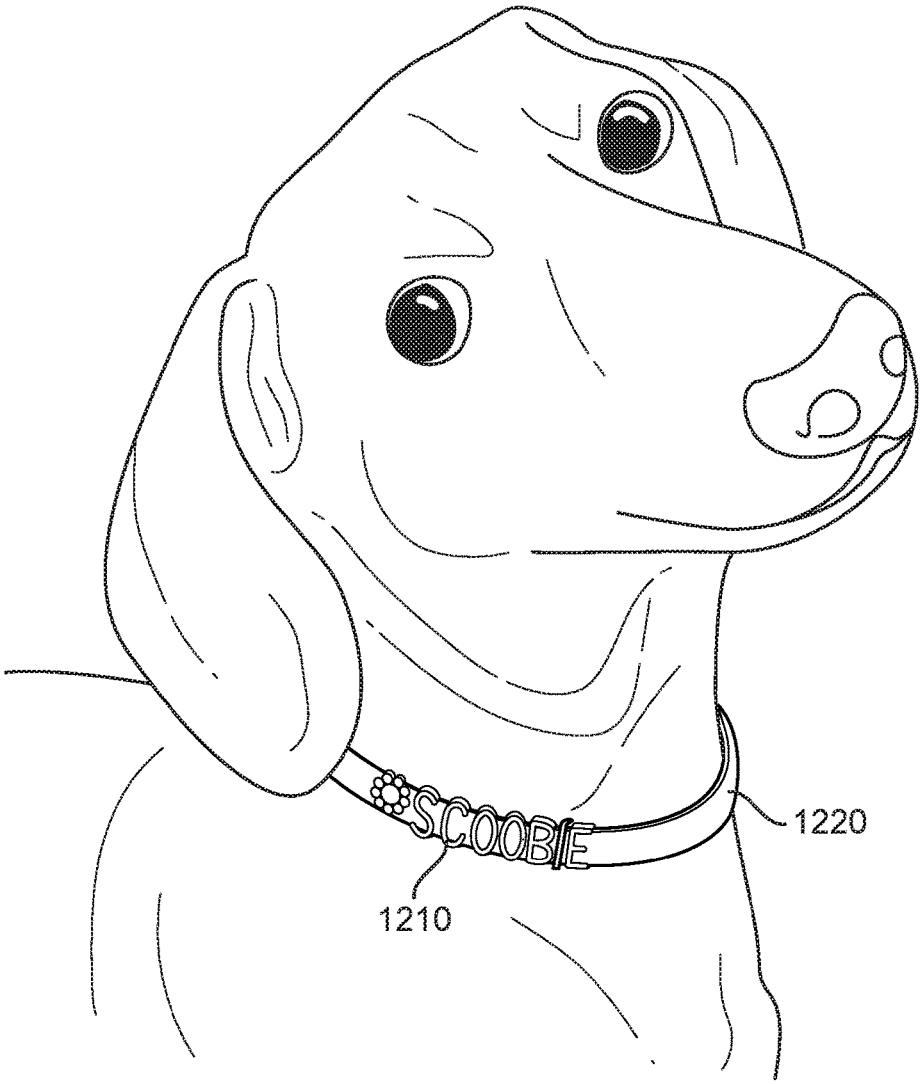
FIG. 12 shows an example of a pet accessory such as a collar with keepsakes.

FIG. 12 shows an example of a pet accessory, such as a collar. The keepsakes 1210 may be mounted directly onto the collar 1220, such that the collar is the substrate. In other embodiments, a pendant/dog-tag may hang down from the collar, or other pet accessory, which may accept one or more keepsakes. The keepsakes may also be mounted on a strap for the pet that may go around one or more other portion of the pet, such as the torso or legs. The keepsakes may be mounted onto a leash portion that may extend from the pet. The pet may be a dog, cat, rodent (e.g., mouse, rat, hamster, gerbil, guinea pig, rabbit), bird, snake, lizard, turtle, horse, goat, pig, sheep, cow, or any other type of pet. The pet accessory may go around the pet's neck, torso, leg, paw, wing, hoof, or any other portion of the pet.

Figure 13:
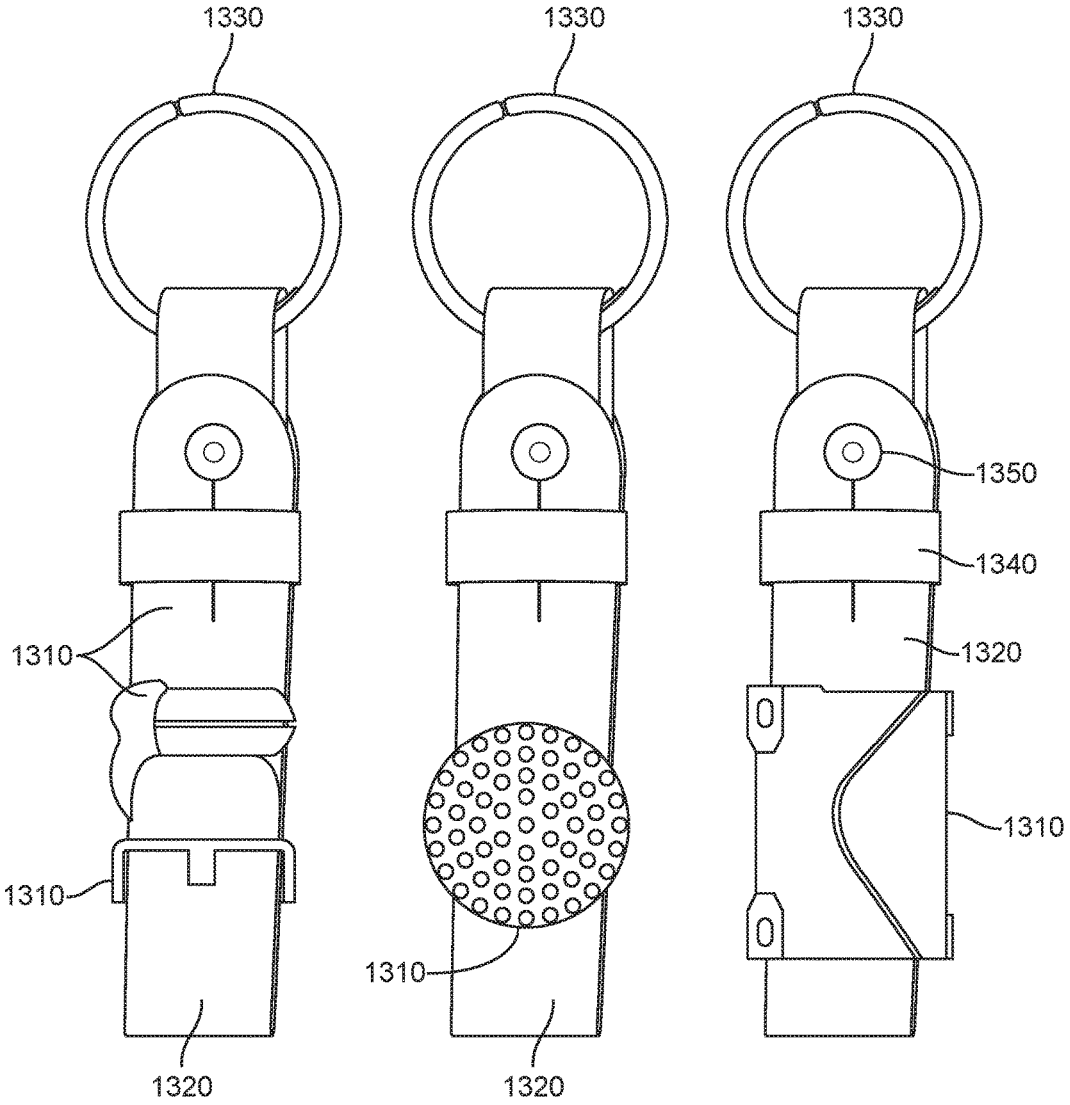
FIG. 13 shows examples of keychains with keepsakes.

FIG. 13 shows examples of keychains with one or more keepsakes 1310 thereon. The keychains may include a keychain body 1320 onto which the keepsakes may slide. The keychain bodies may have an elongated shape onto which the keepsakes may slide. In some embodiments, an end of the keychain body may be secured to a ring 1330. A free end of the keychain body may accept one or more keepsakes to slide on or off when in an open configuration. In some instances, the free end of the keychain body may be put into a closed configuration. Straps 1340, fasteners 1350, magnets, or other features may be used alone or in combination, to keep the keychain body in a closed position. The keepsakes may not slide on or off the keychain when the body is in a closed position. The keychain body may be formed from any material, as described elsewhere herein. In some embodiments, the keychain bodies may have dangling substrates, similar to single-connection pendants, or may have a pendant-type body.

Such illustrates are provided by way of example only and are not limiting. Any description of jewelry/accessory substrates or elongate members may apply to any other type of jewelry/accessory substrate or elongate member as described herein.

In some embodiments, keepsakes may be pieces without moving parts. In some embodiments, keepsakes are provided as single integral pieces. Alternatively, keepsakes may be multiple parts that are attached to one another. In other embodiments, keepsakes may include moving parts. The parts may move with aid of manual intervention by a user. Alternatively, the parts may move without manual intervention by the user. In some instances, electrical, magnetic, or mechanical components may be provided that may cause moving of parts.

Figure 9A:
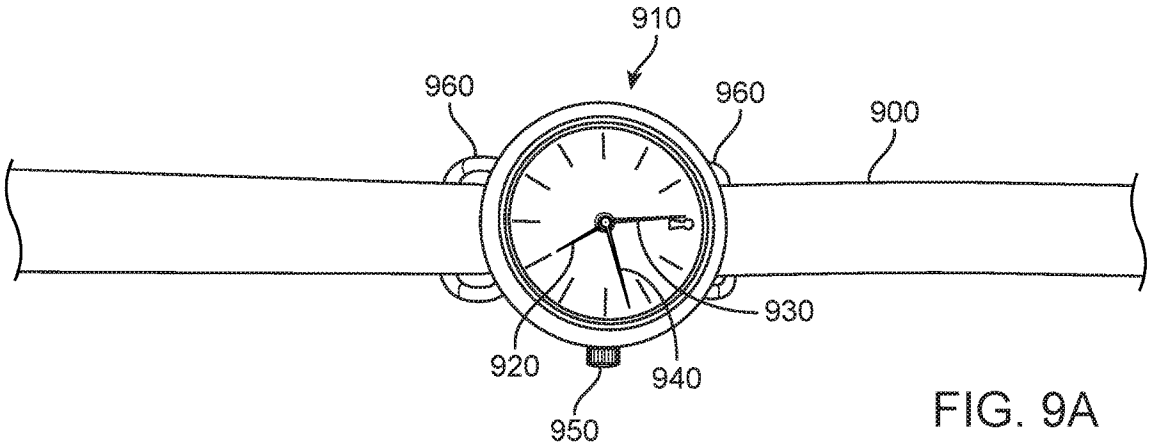
FIGS. 9A-9B show an example of a keepsake that may be timepiece, in accordance with an embodiment of the invention.
Figure 9B:
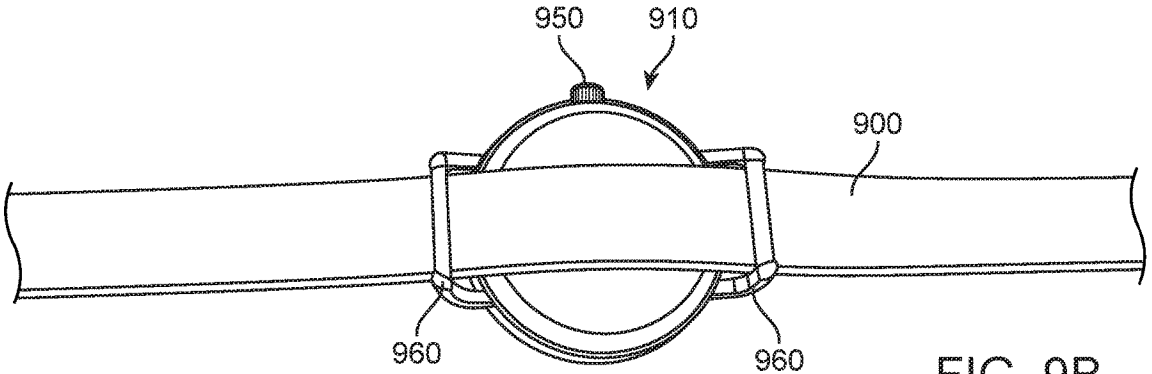

FIGS. 9A-9B show an example of a keepsake that may be timepiece, in accordance with an embodiment of the invention. FIG. 9A shows a front side of a timepiece keepsake 910 on a wristband 900. FIG. 9B shows a back side of a timepiece keepsake on a wristband.

The timepiece keepsake 910 may be a clock. The timepiece keepsake may be worn as a watch on the wrist. The timepiece keepsake may include arms 920, 930, 940 that may move. The arms may be mechanically or electrically driven. In some instances, the arms may include an arm representative of the hour, an arm representative of the minute, and/or an arm representative of the second. In some instances, the timepiece keepsake may include a winder 950 that may permit a user to mechanically wind the timepiece.

The keepsake may include side bars 960 through which the wristband may pass. The wristband may pass over a side bar, under a clock face, and over another side bar. The keepsake may be shaped and/or dimensioned so that the wristband remains frictionally fit with the timepiece. The wristband may be bent or forced into a curve by the shape of the timepiece. The friction may be sufficient to prevent the timepiece keepsake from sliding around the wristband when worn. The side bars may optionally not overlap with the face of the timepiece. Alternatively, the side bars may have other configurations which may permit overlapping with the face of the timepiece.

The timepiece may be slid onto a wristband as illustrated. The timepiece may optionally be slid onto other jewelry substrates. In some instances, the timepiece may be combined with other keepsakes on the wristband or other jewelry substrates. In some instances, natural spacing may be provided between the keepsakes, including the timepiece keepsake. For example, if another keepsake is slid next to the timepiece keepsake, the front face of the timepiece and the adjacent keepsake may not contact one another. The side bar of the timepiece and the rear side of the keepsake may optionally contact one another.

In some alternative embodiments, the timepiece keepsake may have a rear side that is designed similar to the rear side of the other keepsakes as described elsewhere herein. A rear side of a timepiece keepsake may optionally overlap with a front side of the timepiece keepsake. For example, if a cross-section is taken of the timepiece, the front side and the rear side of the timepiece may appear simultaneously. The rear side may include cross bars that may extend along the entire width of the wristband. Any description herein of other keepsakes may apply to the timepiece keepsake.

Figure 9C:
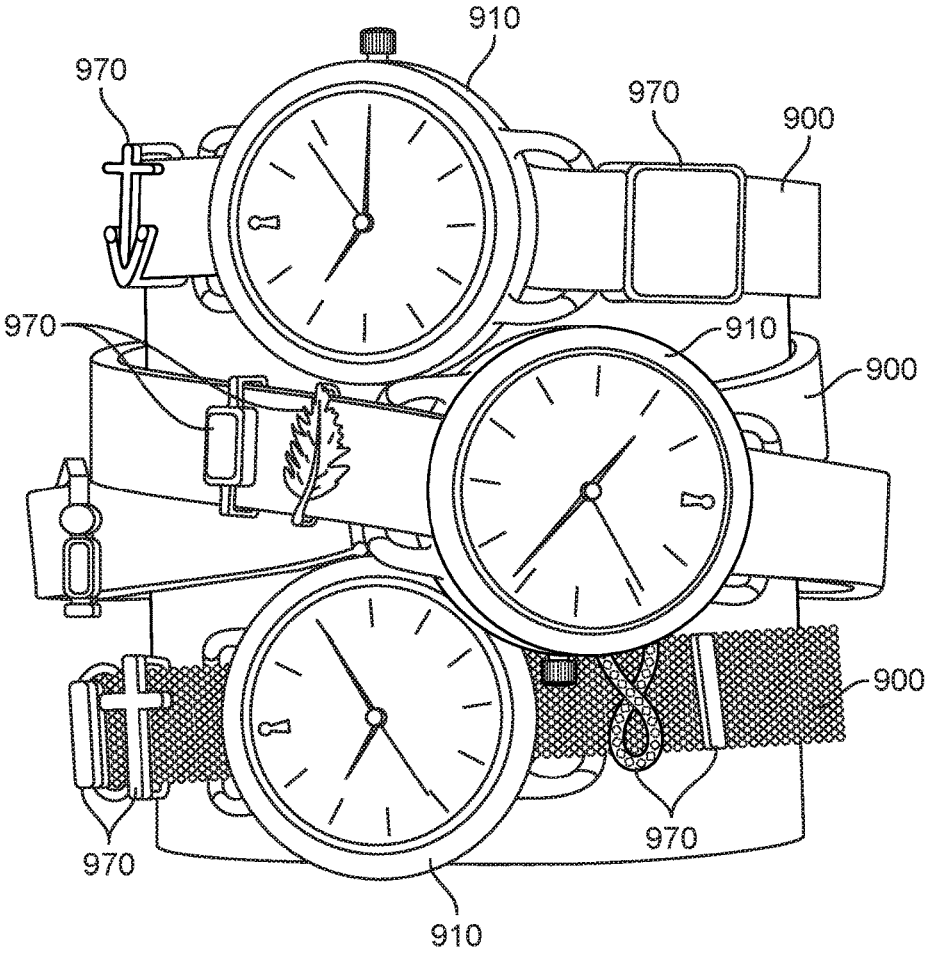
FIG. 9C shows an example of watches which may include a timepiece keepsake and/or other keepsakes.

FIG. 9C shows an example of watches which may include a timepiece keepsake 910 and/or other keepsakes 970.

The watch may include a regular timepiece that may be integrated with a strap 900 of the watch. Alternatively, the watch may include a timepiece keepsake 910 which may slide onto the strap. The watch may include one or more additional keepsakes 970. The other keepsakes may slide onto the same strap as the timepiece keepsake. The other keepsakes may provide decoration and/or ornamentation for the watch.

The watch strap 900 may be formed from any material or have any configuration as described elsewhere herein. The watch strap may have any combination of characteristics described.

Figure 10:
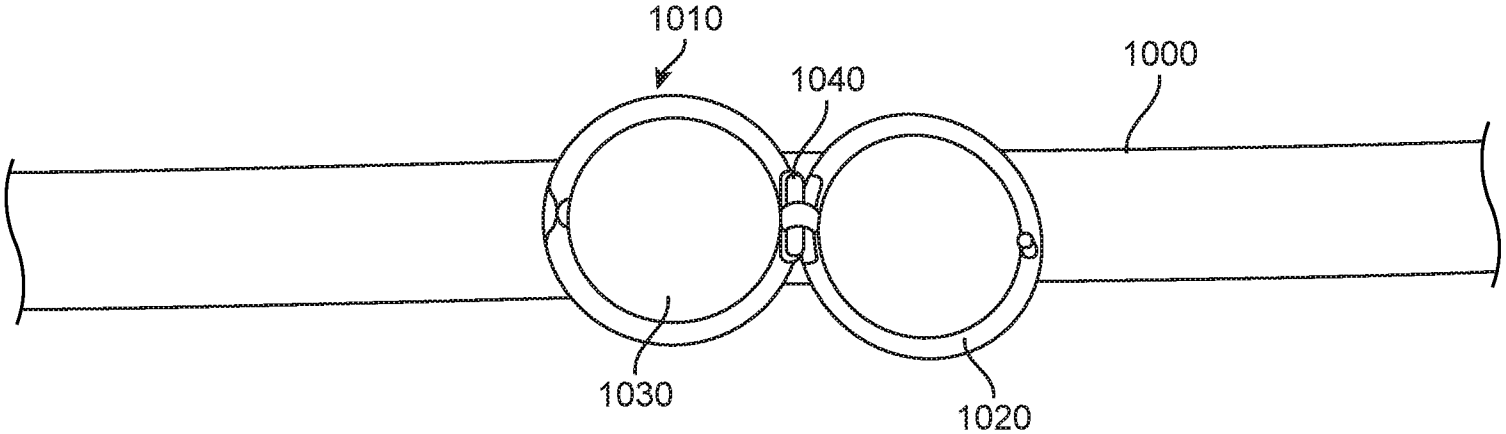
FIG. 10 shows an example of a keepsake that may be a locket, in accordance with an embodiment of the invention.

FIG. 10 shows an example of a keepsake that may be a locket 1010, in accordance with an embodiment of the invention. The locket keepsake may be applied to a jewelry substrate, such as a wristband 1000. The locket keepsake may slide onto any type of jewelry substrate described herein. The locket keepsake may slide on or off the jewelry substrate in any manner as described elsewhere herein. In some instances, the locket substrate may frictionally fit with the jewelry substrate so that the locket does not slide around when the jewelry substrate is worn. The locket may remain in place unless the wearer pushes or pulls the locket keepsake.

The locket keepsake may include a cover portion 1020 and a base portion 1030 that may move relative to one another. For example, the cover portion may move about a pivot point 1040 between an open position and a closed position. In some instances, an inner surface of the cover portion and an inner surface of the base portion may receive a picture or other item therein. The locket may be used to store photos or other items.

In some instances, the locket keepsake may have a rear side, as described for other keepsakes. In some instances, the locket substrate back side may have a greater length than the front face of the locket. In some instances, if a keepsake is slid onto the jewelry substrate adjacent to the locket, the front face of the keepsake and the front side of the locket may not come into contact, even when the rear sides of the keepsake and the locket have come into contact. Thus, natural spacing may be provided. Alternatively, the front side of the keepsake and the locket may come into contact with one another.

Any combination of jewelry substrates and keepsakes may be used to provide personalized jewelry and accessories. The keepsakes may be sliding keepsakes that may attach to the jewelry substrate by being slid onto the jewelry substrate from an end of the jewelry substrate. The keepsakes may be swapped out for one another on a jewelry substrate. Similarly, different jewelry substrates may be used with selected keepsakes.

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. An accessory comprising:

a base comprising a flat elongated member having a front face and an opposing back face;

at least one keepsake that slides onto the elongated member, wherein the keepsake has a front side contacting the front face of the elongated member and showing a decorative portion of the keepsake, and a back side contacting the back face of the elongated member, and at least one side bar extending between the front side and the back side, and wherein the back side overlaps with at least a portion of the front side and extends beyond a length of the front side, and wherein the back side of the keepsake includes (1) at least one cross bar extending along the width of the keepsake at a first orientation, (2) one or more side or extension features extending in a direction along a length of the elongated member at a second orientation different from the first orientation and contacting the back face of the elongated member, and (3) at least one hole completely encircled by the at least one cross bar and the one or more side or extension features, wherein the cross bar and the one or more side or extension features intersect on the back side of the keepsake, wherein the one or more side or extension features contact the at least one side bar and extend beyond the length of the front side, and wherein the back side frictionally fits the keepsake on the elongated member.

2. The accessory of claim 1, wherein the base is a bracelet.

3. The accessory of claim 2, wherein the bracelet is a semi-rigid wristband, mesh bracelet, or a bangle.

4. The accessory of claim 1, wherein the front side of the keepsake has a substantially flat inner surface and wherein the back side of the keepsake has a substantially flat inner surface.

5. The accessory of claim 1, wherein the front side of the keepsake or the back side of the keepsake has an inner surface that includes visually detectable curves, bumps, or grooves.

6. The accessory of claim 5, wherein the curves, bumps, or grooves prevent sliding of the keepsake in the absence of an external force.

7. The accessory of claim 1 wherein the back side including the at least one cross bar and the one or more side or extension features is formed of a single integral piece.

8. An accessory comprising:

a base comprising a flat elongated member having a front face and an opposing back face;

a first keepsake that slides onto the elongated member, wherein the first keepsake has (1) a first front side contacting the front face of the elongated member and showing a decorative portion of the keepsake, (2) a first back side contacting the back face of the elongated member, and (3) at least one side bar extending between the first front side and the first back side, wherein the first back side overlaps with at least a portion of the first front side and extends beyond a length of the first front side, wherein the back side of the keepsake includes (1) at least one cross bar having a first orientation, (2) at least one or more side or extension features extending in a direction along a length of the elongated member at a second orientation different from the first orientation and contacting the back face of the elongated member, and (3) at least one hole completely encircled by the at least one cross bar and the one or more side or extension features, wherein the cross bar and the one or more side or extension features intersect on the back side of the keepsake, and wherein the one or more side or extension features contact the at least one side bar and extend beyond the length of the front side; and a second keepsake that slides onto the elongated member, wherein the second keepsake has a second front side contacting the front face of the elongated member and showing a decorative portion of the keepsake, and a second back side contacting the back face of the elongated member and overlapping with at least a portion of the second front side, wherein the first front side and the second front side are configured to be spaced apart, and not come into contact with one another when an edge of the first back side comes into contact with an edge of the second back side.

9. The accessory of claim 8 wherein the first keepsake and the second keepsake are configured to be held to a location on the base with the aid of friction between the first keepsake and the base, and between the second keepsake and the base, in the absence of an external force.

10. The accessory of claim 8 further comprising a stopper, wherein the stopper comprises a front side contacting the front face of the elongated member and a back side contacting the back face of the elongated member, and wherein the stopper prevents motion of the first keepsake or the second keepsake past the stopper along the length of the base.

11. The accessory of claim 1, wherein the front side and the back side are substantially planar along an entirety of the length of the front side and an entirety of the length of the back side, and wherein, the front side and the back side are substantially parallel.

12. The accessory of claim 1, wherein the at least one bar contacts the back side and the front side, within the length of the back side and within the length of the front side.

13. The accessory of claim 1, wherein at least a portion of the one or more side or extension features is curved.

14. The accessory of claim 1, wherein the one or more side or extension features is perpendicular to the cross bar where the one or more side extension features intersects the cross bar on the back side of the keepsake.

15. The accessory of claim 1, wherein distances the back side extends beyond the front side on right and left sides of the keepsake are the same.

* * * * *